US006547380B2

(12) United States Patent
Smith et al.

(10) Patent No.: US 6,547,380 B2
(45) Date of Patent: Apr. 15, 2003

(54) INK JET PRINTING PROCESS

(75) Inventors: Thomas W. Smith, Penfield, NY (US); Kathleen M. McGrane, Webster, NY (US); David J. Luca, Rochester, NY (US); William W. Limburg, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/911,111

(22) Filed: Jul. 23, 2001

(65) Prior Publication Data

US 2001/0050700 A1 Dec. 13, 2001

Related U.S. Application Data

(62) Division of application No. 09/152,100, filed on Sep. 11, 1998, now Pat. No. 6,312,121.

(51) Int. Cl.[7] ..... B41J 2/17; B41J 2/101

(52) U.S. Cl. ..... 347/96; 347/100

(58) Field of Search ..... 347/15, 96, 98, 347/100, 101; 106/31.27, 31.13

(56) References Cited

U.S. PATENT DOCUMENTS

| | | | | |
|---|---|---|---|---|
| 3,850,649 A | | 11/1974 | Buerkley et al. | 106/21 |
| 3,870,435 A | | 3/1975 | Watanabe et al. | 117/36.2 |
| 4,646,110 A | * | 2/1987 | Ikeda et al. | 347/15 |
| 4,694,302 A | | 9/1987 | Hackleman et al. | 347/96 |

(List continued on next page.)

FOREIGN PATENT DOCUMENTS

| | | |
|---|---|---|
| DE | 2505077 | 5/1980 |
| EP | 0 641 670 A1 | 3/1995 |
| GB | 1398334 | 6/1975 |
| JP | 77049366 B | 12/1977 |
| JP | 57-018264 | 1/1982 |
| JP | 9030107 A | 2/1997 |
| JP | 10 183038 A2 | 7/1998 |

OTHER PUBLICATIONS

W.T. Pimbley, Leuco Dye System for Ink Jet Printing, IBM Technical Disclosure Bulletin, Sep. 1980, vol. 23 No. 4.

*Primary Examiner*—John Barlow
*Assistant Examiner*—Michael S Brooke
(74) *Attorney, Agent, or Firm*—Judith L. Byorick

(57) ABSTRACT

A process comprising (a) incorporating into an ink jet printing apparatus (1) a developing composition comprising a liquid vehicle and a color developer; (2) an oxidizing composition comprising a liquid vehicle and an oxidizing agent; (3) a coloring composition comprising a liquid vehicle and a dye coupler; and (4) a fixing composition comprising a liquid vehicle and a fixative; (b) causing droplets of the developing composition to be ejected in an imagewise pattern onto the substrate; (c) causing droplets of the oxidizing composition to be ejected in an imagewise pattern onto the substrate; (d) causing droplets of the coloring composition to be ejected in an imagewise pattern onto the substrate; and (e) causing droplets of the fixing composition to be ejected in an imagewise pattern onto the substrate; wherein the process results in at least some portions of the substrate bearing images comprising all four of the developing composition, the oxidizing composition, the coloring composition, and the fixing composition, said portions forming a printed image. Specific embodiments of the present invention are directed to the realization of continuous tone and gray scale in images by (1) control of the time at which color forming reactions are quenched by controlling the time period between deposition of the color forming liquids and deposition of the fixing liquid; (2) control of the extent of color forming reactions by limitation of the quantity of one of the color forming liquids; or (3) control of pixel size by drop placement control over the overlap areas of drops of color forming liquids.

11 Claims, 13 Drawing Sheets

U.S. PATENT DOCUMENTS 5,260,181 A * 11/1993 Sato et al. ..... 430/558
5,443,629 A 8/1995 Saville et al. ..... 106/21 A
5,477,301 A 12/1995 Earle et al. ..... 354/325
5,635,969 A * 6/1997 Allen ..... 347/96
6,164,772 A * 12/2000 Koitabashi et al. ..... 347/100

* cited by examiner

INK JET PRINTING PROCESS

PRIORITY

This application is a divisional of Ser. No. 09/152,100, now U.S. Pat. No. 6,312,121, filed Sep. 11, 1998.

BACKGROUND OF THE INVENTION

The present invention is directed to an ink jet printing process. More specifically, the present invention is directed to an ink jet printing process wherein color forming liquids ("inks") are jetted onto a substrate. One embodiment of the present invention is directed to a process which comprises (a) incorporating into an ink jet printing apparatus (1) a developing composition comprising a liquid vehicle and a color developer; (2) an oxidizing composition comprising a liquid vehicle and an oxidizing agent; (3) a coloring composition comprising a liquid vehicle and a dye coupler; and (4) a fixing composition comprising a liquid vehicle and a fixative; (b) causing droplets of the developing composition to be ejected in an imagewise pattern onto the substrate; (c) causing droplets of the oxidizing composition to be ejected in an imagewise pattern onto the substrate; (d) causing droplets of the coloring composition to be ejected in an imagewise pattern onto the substrate; and (e) causing droplets of the fixing composition to be ejected in an imagewise pattern onto the substrate; wherein the process results in at least some portions of the substrate bearing images comprising all four of the developing composition, the oxidizing composition, the coloring composition, and the fixing composition, said portions forming a printed image.

Ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Since drop-on-demand systems require no ink recovery, charging, or deflection, the system is much simpler than the continuous stream type. There are three types of drop-on-demand ink jet systems. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies. Drop-on-demand systems which use piezoelectric devices to expel the droplets also suffer the disadvantage of a slow printing speed.

Another type of drop-on-demand system is known as acoustic ink printing. As is known, an acoustic beam exerts a radiation pressure against objects upon which it impinges. Thus, when an acoustic beam impinges on a free surface (i.e., liquid/air interface) of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power. These principles have been applied to prior ink jet and acoustic printing proposals. For example, K. A. Krause, "Focusing Ink Jet Head," *IBM Technical Disclosure Bulletin,* Vol. 16, No. 4, September 1973, pp. 1168–1170, the disclosure of which is totally incorporated herein by reference, describes an ink jet in which an acoustic beam emanating from a concave surface and confined by a conical aperture was used to propel ink droplets out through a small ejection orifice. Acoustic ink printers typically comprise one or more acoustic radiators for illuminating the free surface of a pool of liquid ink with respective acoustic beams. Each of these beams usually is brought to focus at or near the surface of the reservoir (i.e., the liquid/air interface). Furthermore, printing conventionally is performed by independently modulating the excitation of the acoustic radiators in accordance with the input data samples for the image that is to be printed. This modulation enables the radiation pressure which each of the beams exerts against the free ink surface to make brief, controlled excursions to a sufficiently high pressure level for overcoming the restraining force of surface tension. That, in turn, causes individual droplets of ink to be ejected from the free ink surface on demand at an adequate velocity to cause them to deposit in an image configuration on a nearby recording medium. The acoustic beam may be intensity modulated or focused/defocused to control the ejection timing, or an external source may be used to extract droplets from the acoustically excited liquid on the surface of the pool on demand. Regardless of the timing mechanism employed, the size of the ejected droplets is determined by the waist diameter of the focused acoustic beam. Acoustic ink printing is attractive because it does not require the nozzles or the small ejection orifices which have caused many of the reliability and pixel placement accuracy problems that conventional drop on demand and continuous stream ink jet printers have suffered. The size of the ejection orifice is a critical design parameter of an ink jet because it determines the size of the droplets of ink that the jet ejects. As a result, the size of the ejection orifice cannot be increased, without sacrificing resolution. Acoustic printing has increased intrinsic reliability because there are no nozzles to clog. As will be appreciated, the elimination of the clogged nozzle failure mode is especially relevant to the reliability of large arrays of ink ejectors, such as page width arrays comprising several thousand separate ejectors. Furthermore, small ejection orifices are avoided, so acoustic printing can be performed with a greater variety of inks than conventional ink jet printing, including inks having higher viscosities and inks containing pigments and other particulate components. It has been found that acoustic ink printers embodying printheads comprising acoustically illuminated spherical focusing lenses can print precisely positioned pixels (i.e., picture elements) at resolutions which are sufficient for high quality printing of relatively complex images. It has also has been discovered that the size of the individual pixels printed by such a printer can be varied over a significant range during operation, thereby accommodating, for example, the printing of variably shaded images. Furthermore, the known droplet ejector technology can be adapted to a variety of printhead configurations, including (1) single ejector embodiments for raster scan printing, (2) matrix configured ejector arrays for matrix printing, and (3) several different types of pagewidth ejector arrays, ranging from single row, sparse arrays for hybrid forms of parallel/serial printing to multiple row staggered arrays with individual ejectors for each of the pixel positions or addresses within a pagewidth image field (i.e., single ejector/pixel/line) for ordinary line printing. Inks suitable for acoustic ink jet printing typically are liquid at ambient temperatures (i.e., about 25° C.), but in other embodiments the ink is in a solid state at ambient temperatures and provision is made for liquefying the ink by heating or any other suitable method prior to introduction of the ink into the printhead. Images of two or more colors can be generated by several methods, including by processes wherein a single printhead launches acoustic waves into pools of different colored inks. Further information regarding acoustic ink jet printing apparatus and processes is disclosed in, for example, U.S. Pat. No. 4,308,547, U.S. Pat. No. 4,697,195, U.S. Pat. No. 5,028,937, U.S. Pat. No. 5,041,849, U.S. Pat. No. 4,751,529, U.S. Pat. No. 4,751,530, U.S. Pat. No. 4,751,534, U.S. Pat. No. 4,801,953, and U.S. Pat. No. 4,797,693, the disclosures of each of which are totally incorporated herein by reference. The use of focused acoustic beams to eject droplets of controlled diameter and velocity from a free-liquid surface is also described in *J. Appl. Phys.*, vol. 65, no. 9 (May 1, 1989) and references therein, the disclosure of which is totally incorporated herein by reference.

Still another type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink vehicle (usually water) in the immediate vicinity to vaporize almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands until all the heat stored in the ink in excess of the normal boiling point diffuses away or is used to convert liquid to vapor, which removes heat due to heat of vaporization. The expansion of the bubble forces a droplet of ink out of the nozzle, and once the excess heat is removed, the bubble collapses on the resistor. At this point, the resistor is no longer being heated because the current pulse has passed and, concurrently with the bubble collapse, the droplet is propelled at a high rate of speed in a direction towards a recording medium. The resistive layer encounters a severe cavitational force by the collapse of the bubble, which tends to erode it. Subsequently, the ink channel refills by capillary action. This entire bubble formation and collapse sequence occurs in about 10 microseconds. The channel can be refired after 100 to 500 microseconds minimum dwell time to enable the channel to be refilled and to enable the dynamic refilling factors to become somewhat dampened. Thermal ink jet processes are well known and are described in, for example, U.S. Pat. No. 4,601,777, U.S. Pat. No. 4,251,824, U.S. Pat. No. 4,410,899, U.S. Pat. No. 4,412,224, and U.S. Pat. No. 4,532,530, the disclosures of each of which are totally incorporated herein by reference.

U.S. Pat. No. 3,870,435 (Watanabe et al.), the disclosure of which is totally incorporated herein by reference, discloses an almost colorless aqueous ink containing a color coupler which is used to inscribe a record on a recording sheet having a coated layer containing a fine white powder and a color developer which reacts with the color coupler to form a visual record of vivid color of highly durable nature.

U.S. Pat. No. 3,850,649 (Buerkley et al.), the disclosure of which is totally incorporated herein by reference, discloses an ink composition which is particularly suitable for lithographic (wet) offset printing and comprises a quick set vehicle mixed with an iron-complexing agent. The composition provides a storable latent (i.e. invisible or concealed) image when printed on a properly selected low iron-content paper. Treatment of the printed latent image with an iron salt develops the image and makes it clearly visible. Visible material can be printed with the latent material on the same paper using a conventional 2-color offset press.

U.S. Pat. No. 5,443,629 (Saville et al.), the disclosure of which is totally incorporated herein by reference, discloses a latent image ink particularly for use in printing forms such as games or coloring books. An offset lithographic press is used for imprinting a substantially invisible image on a sheet of standard paper. The latent ink used to form the latent image is a mixture of potassium ferrocyanide or other suitable color fixing iron complexing compounds, white ink, and varnish. A developing solution such as ferric chloride or ammonium sulfate is subsequently added to the paper to render the image visible.

Japanese Patent Publication JP 77049366 B, the disclosure of which is totally incorporated herein by reference, discloses a recording system which comprises a pen which applies a colorless ink containing a color developer such as potassium ferrocyanide and a hygroscopic compound such as glycerol dissolved in water to a paper coated with a white mineral powder and a colorless compound such as iron alum which forms color on reacting with the color developer.

Japanese Patent Publication JP 9030107 A, the disclosure of which is totally incorporated herein by reference, discloses a process which includes ejection of droplets of multiple color ink compositions to a recording medium having an absorbing layer for coloring agents to make the coloring agent in the ink composition adhere to the recording image to form a color image. Each of the coloring agents in the color ink compositions are localized at a specific depth of the absorbing layer for coloring agents, and the coloring agents having different color tone do not mingle at the same depth in the absorbing layer. Improved color reproduction can be achieved when multiple types of coloring agent are printed on the same position.

British Patent Publication GB 1398334, the disclosure of which is totally incorporated herein by reference, discloses a printing ink composition capable of forming latent images which can be rendered visible by reaction with metal salts which comprises (1) at least 40 percent by weight of a color stable, quick set vehicle free of metallic driers and having sufficient tack, viscosity, hydrophobicity, and pigment carrying capacity for use in lithographic offset printing, and, dispersed in the vehicle, (2) at least 10 percent of a light colored, solid, particulate water insoluble reactant having an average particle size of 0.5 to 5.0 microns and being capable of forming a strongly colored complex with a coreactant iron salt. The composition is particularly useful for the printing of educational aids such as self-answering examination sheets.

German Patent Publication DE 2505077, the disclosure of which is totally incorporated herein by reference, discloses a water borne writing or printing liquid for producing an invisible recording which contains a mixture of gallic acid and alkali gallate which will react with heavy metal salts.

"Leuco Dye System for Ink Jet Printing," W. T. Pimbley, IBM Technical Disclosure Bulletin, Vol. 23, No. 4, p. 1387 (September 1980), the disclosure of which is totally incorporated herein by reference, discloses ink jet printing with improved archival properties by using leuco or vat dyes. The dyes convert to their permanent form when oxidized. The record medium is first coated or impregnated with an oxidizing agent such as acidic materials, such as acidified clays, organic acids, or polymeric phenols. Upon combining with the oxidant, the dyes convert to their permanent form, becoming insoluble and having high tinctorial strength and excellent archival properties, such as waterfastness and lightfastness.

While known compositions and processes are suitable for their intended purposes, a need remains for improved ink jet printing processes. In addition, a need remains for ink jet printing processes which enable generation of photographic quality images on plain paper. Further, a need remains for ink jet printing processes which enable increased color gamut. Additionally, a need remains for ink jet printing processes which enable increased color intensity. There is also a need for ink jet printing processes which generate permanent and waterfast images. In addition, there is a need for ink jet printing processes which exhibit desirable throughput speed. Further, there is a need for ink jet printing processes which enable gray level printing without specific regard to drop ejector resolution, wherein near continuous tone or multigray level images can be realized with simple 300 dpi (dots per inch) drop ejectors. Additionally, there is a need for ink jet printing processes which enable the printing of continuous tone pictorial images without specific regard to drop ejector resolution. A need also remains for ink jet printing processes which enable production of variable spot sizes. In addition, a need remains for ink jet printing processes which enable production of high resolution images.

SUMMARY OF THE INVENTION

It is an object of the present invention to provide ink jet printing processes with the above noted advantages.

It is another object of the present invention to provide improved ink jet printing processes.

It is yet another object of the present invention to provide ink jet printing processes which enable generation of photographic quality images on plain paper.

It is still another object of the present invention to provide ink jet printing processes which enable increased color gamut.

Another object of the present invention is to provide ink jet printing processes which enable increased color intensity.

Yet another object of the present invention is to provide ink jet printing processes which generate permanent and waterfast images.

Still another object of the present invention is to provide ink jet printing processes which exhibit desirable throughput speed.

It is another object of the present invention to provide ink jet printing processes which enable gray level printing without specific regard to drop ejector resolution, wherein near continuous tone or multigray level images can be realized with simple 300 dpi (dots per inch) drop ejectors.

It is yet another object of the present invention to provide ink jet printing processes which enable the printing of continuous tone pictorial images without specific regard to drop ejector resolution.

It is still another object of the present invention to provide ink jet printing processes which enable production of variable spot sizes.

Another object of the present invention is to provide ink jet printing processes which enable production of high resolution images.

These and other objects of the present invention (or specific embodiments thereof) can be achieved by providing a process which comprises (a) incorporating into an ink jet printing apparatus (1) a developing composition comprising a liquid vehicle and a color developer; (2) an oxidizing composition comprising a liquid vehicle and an oxidizing agent; (3) a coloring composition comprising a liquid vehicle and a dye coupler; and (4) a fixing composition comprising a liquid vehicle and a fixative; (b) causing droplets of the developing composition to be ejected in an imagewise pattern onto the substrate; (c) causing droplets of the oxidizing composition to be ejected in an imagewise pattern onto the substrate; (d) causing droplets of the coloring composition to be ejected in an imagewise pattern onto the substrate; and (e) causing droplets of the fixing composition to be ejected in an imagewise pattern onto the substrate; wherein the process results in at least some portions of the substrate bearing images comprising all four of the developing composition, the oxidizing composition, the coloring composition, and the fixing composition, said portions forming a printed image.

DETAILED DESCRIPTION OF THE INVENTION

The present invention is directed to a process which comprises (a) incorporating into an ink jet printing apparatus (1) a developing composition comprising a liquid vehicle and a color developer; (2) an oxidizing composition comprising a liquid vehicle and an oxidizing agent; (3) a coloring composition comprising a liquid vehicle and a dye coupler; and (4) a fixing composition comprising a liquid vehicle and a fixative; (b) causing droplets of the developing composition to be ejected in an imagewise pattern onto the substrate; (c) causing droplets of the oxidizing composition to be ejected in an imagewise pattern onto the substrate; (d) causing droplets of the coloring composition to be ejected in an imagewise pattern onto the substrate; and (e) causing droplets of the fixing composition to be ejected in an imagewise pattern onto the substrate; wherein the process results in at least some portions of the substrate bearing images comprising all four of the developing composition, the oxidizing composition, the coloring composition, and the fixing composition, said portions forming a printed image. In one embodiment, only one coloring composition is incorporated into the printing apparatus, and the resulting images are of a single color. In another embodiment, at least two different coloring compositions are incorporated into the printing apparatus, and the resulting images are of at least two different colors. In one specific embodiment, three different coloring compositions are incorporated into the printing apparatus, one containing a cyan dye coupler, one containing a magenta dye coupler, and one containing a yellow dye coupler, thereby enabling the production of full color images. Specific embodiments of the present invention are directed to the realization of continuous tone and gray scale in images by (1) control of the time at which color forming reactions are quenched by controlling the time period between deposition of the color forming liquids and deposition of the fixing liquid; (2) control of the extent of color forming reactions by limitation of the quantity of one of the color forming liquids (i.e., the coloring composition, the developing composition, or the oxidizing composition); or (3) control of pixel size by drop placement control over the overlap areas of drops of color forming liquids.

The present invention can employ any suitable or desired ink jet printing apparatus, including continuous stream ink jet printers, piezoelectric ink jet printers, thermal ink jet printers, acoustic ink jet printers, hot melt ink jet printers of any of the above types, or the like. Illustrated below are some examples of suitable apparatus for the present invention; these examples are illustrative in nature and should not be construed to limit the scope of the invention in any way.

Figure 1:
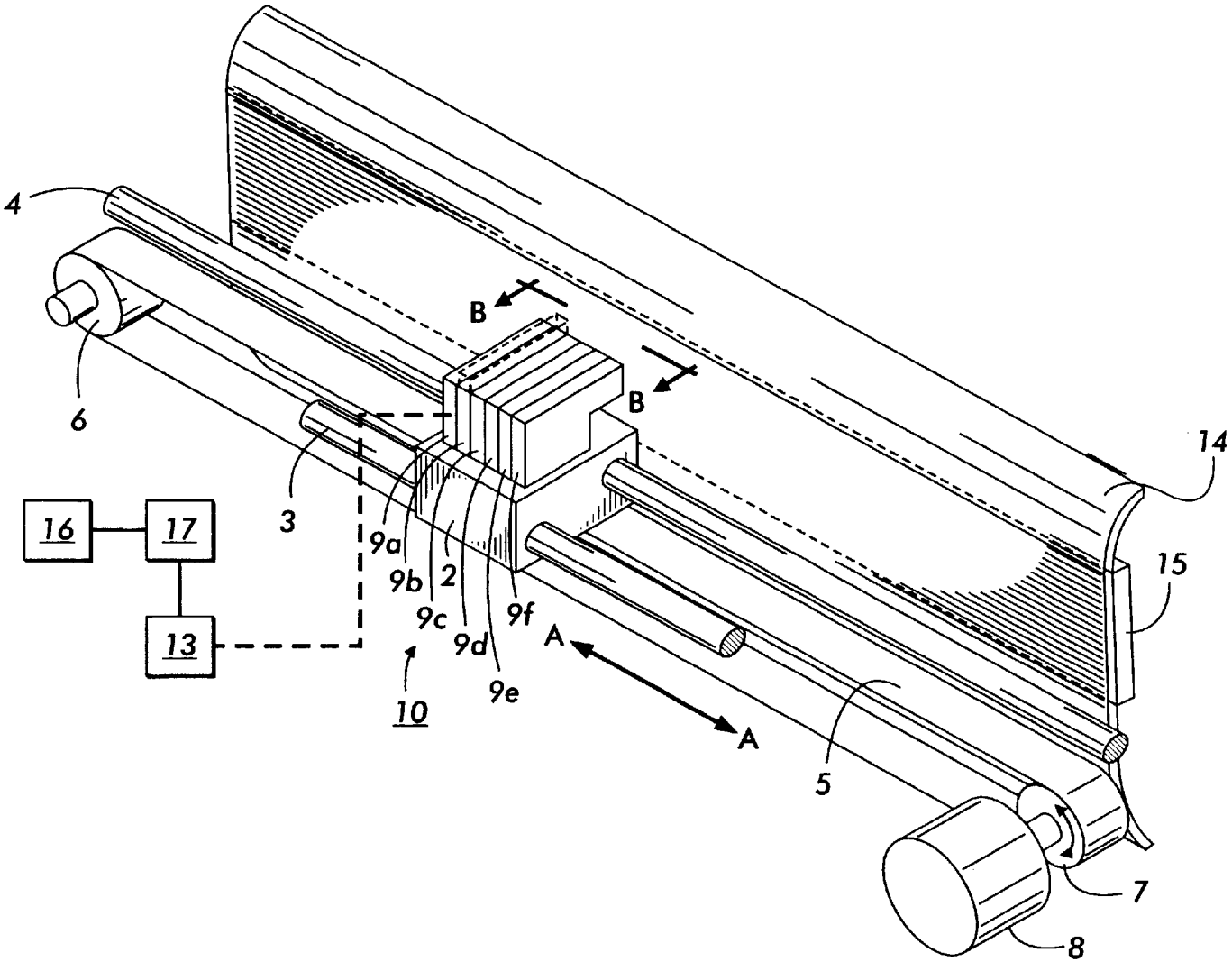
FIG. 1 is a perspective view illustrating a multicolor, multi-printhead, scanning type thermal ink jet printer useful for the present invention.

FIG. 1 shows a three-color printing mechanism 1 including a carriage 2 mounted for reciprocation in the directions of arrow A—A on guide rails 3 and 4 secured to a frame (not shown) of the printer. The carriage is driven along the guide rails by a suitable mechanism such as a drive belt 5 supported between idler pulley 6 and drive pulley 7, and driven by motor 8.

In the illustrated embodiment, to make a composite, multi-color image, recording heads 9*a*, 9*b*, 9*c*, 9*d*, 9*e*, and 9*f* (delivering a developing composition, an oxidizing composition, a coloring composition containing a yellow dye coupler, a coloring composition containing a magenta dye coupler, a coloring composition containing a cyan dye coupler, and a fixing composition, respectively) are mounted in respective cartridge holders provided on the carriage 2. In another embodiment (not shown), four recording heads are provided, with one delivering a coloring composition, wherein the resulting images are monochrome. Each cartridge holder includes appropriate mechanical, electrical and fluid couplings so that selected ink drivers can be activated in response to a suitable driving signal from a controller 13 to expel ink from the cartridges onto a recording substrate 14 supported upon a platen 15.

Controller 13, which may be a microprocessor or computer, receives signals representing a color composite image from an image generator 16. Image generators are well known in the art. Examples of a suitable image generator 16 are a scanner or digitizer that scans data from a color original and generates signals in a predetermined color space representing color readings, or a computer and associated software and/or user interfaces that generate digital image signals in a predetermined color space. There are many accepted standards of color space format such as RGB, CYMK, CIELAB, CIELUV and others. Signals from generator 16 are preferably stored at least temporarily in a buffer memory 17. Memory 17 can be a RAM or ROM.

Figure 2:
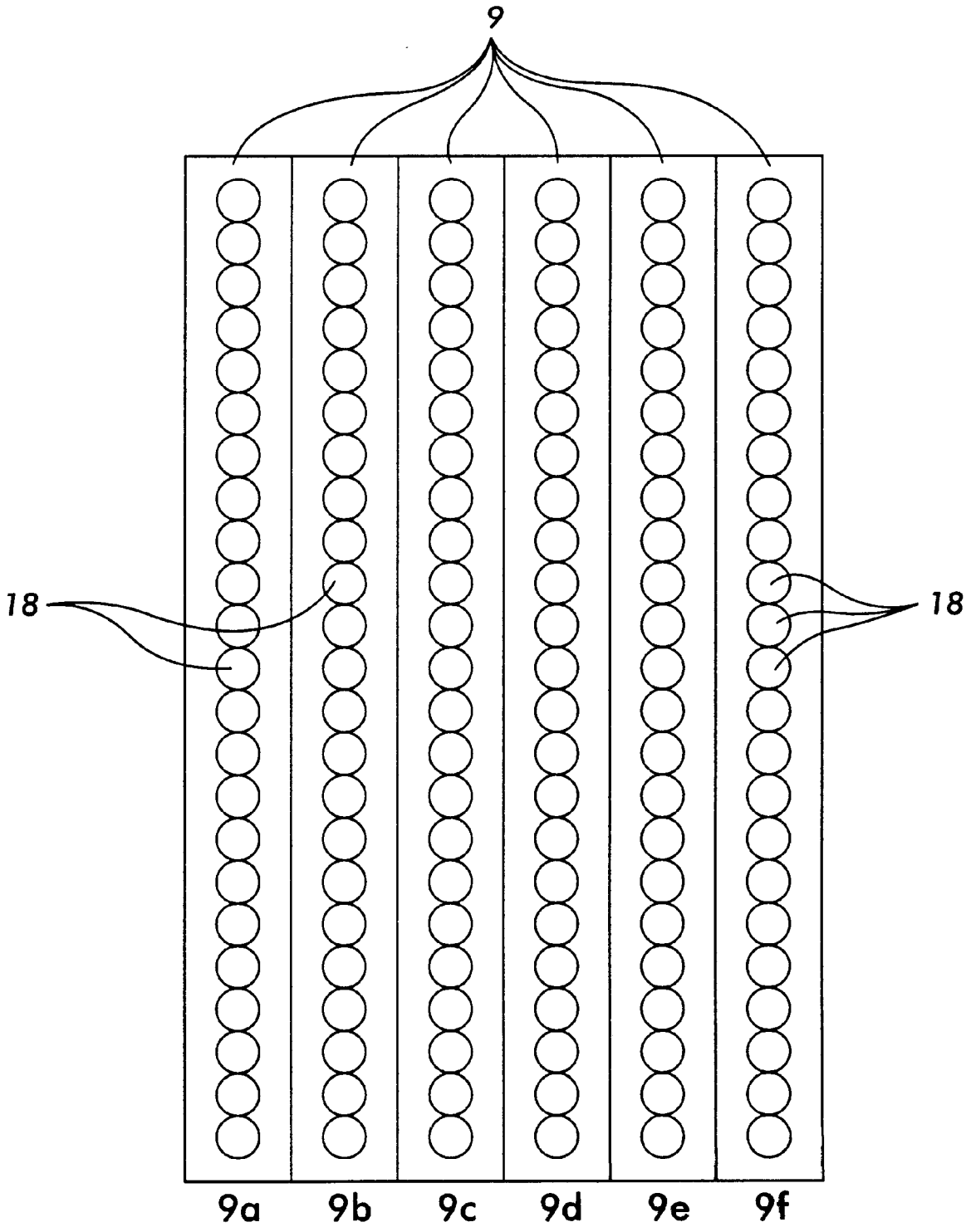
FIG. 2 is a view taken along line B—B of FIG. 1, illustrating the nozzle arrays of the multicolor, multi-printhead thermal ink jet recording head assembly.

As shown in FIG. 2, each cartridge 9 is provided with an array of aligned nozzles 18. The nozzles can be of any size and spacing depending on the desired resolution of the printing device. For example, if a resolution of 300 spots per inch is preferred, each nozzle would be approximately 2 mil in diameter and would be spaced on about 3.3 mil centers.

Printheads suitable for use in the apparatus illustrated in FIGS. 1 and 2, including both "sideshooter" and "roofshooter" configurations, are disclosed in, for example, U.S. Pat. No. 4,638,337, U.S. Pat. No. 4,601,777, U.S. Pat. No. 5,739,254, U.S. Pat. No. 5,753,783, U.S. Pat. No. 4,678,529, U.S. Pat. No. 4,567,493, U.S. Pat. No. 4,568,953, U.S. Pat. No. 4,789,425, U.S. Pat. No. 4,985,710, U.S. Pat. No. 5,160,945, U.S. Pat. No. 4,935,750, and U.S. Patent Re. 32,572, the disclosures of each of which are totally incorporated herein by reference.

Figure 3:
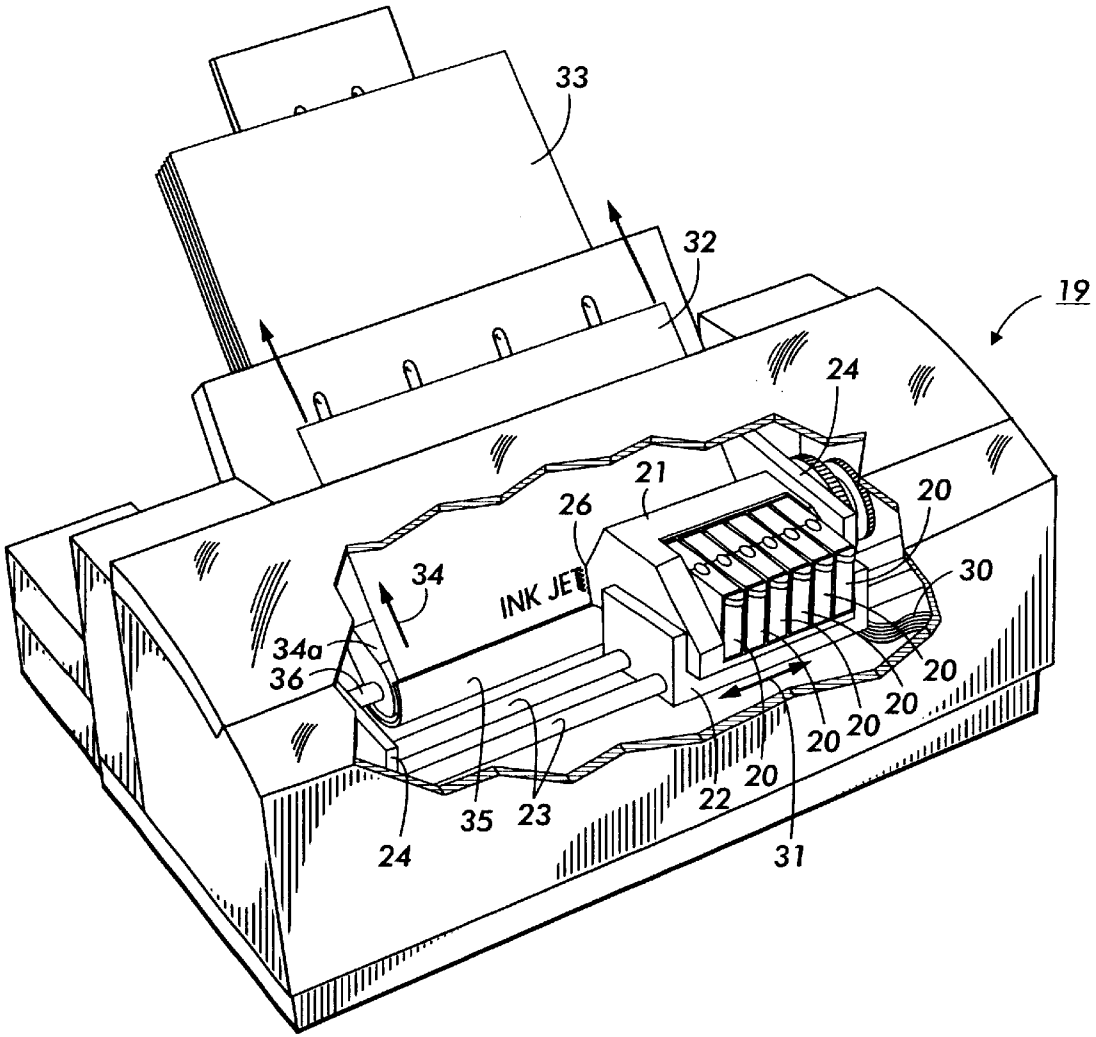
FIG. 3 is an isometric view of a multicolor, single printhead thermal ink jet printer having replaceable ink jet supply tanks useful for the present invention.
Figure 4:
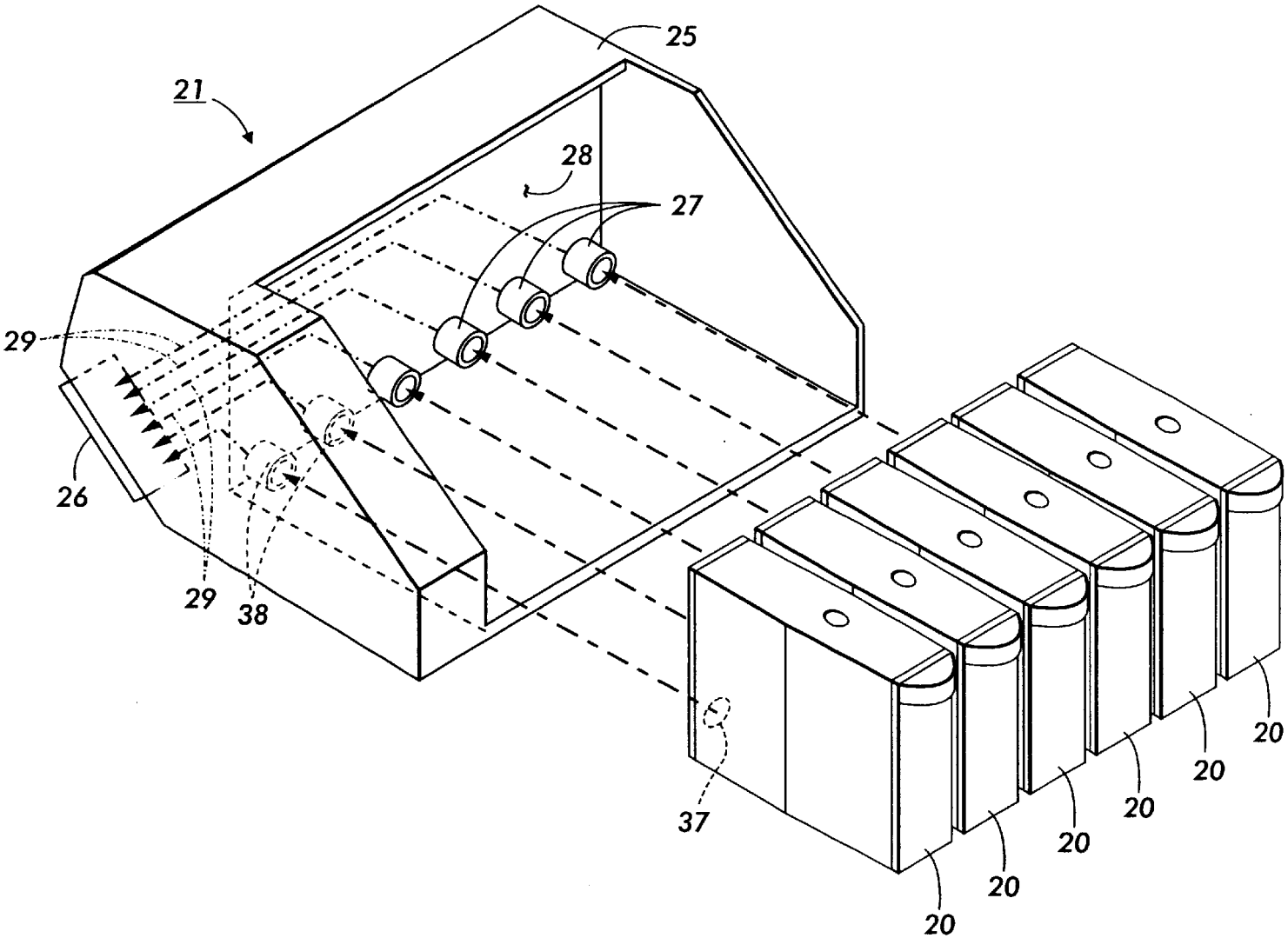
FIG. 4 is a partially exploded isometric view of a multicolor, single printhead thermal ink jet cartridge used in the printer of FIG. 3 with integral printhead and ink connectors and replaceable ink tanks.

FIG. 3 illustrates an isometric view of a multicolor, single printhead thermal ink jet printer 19 which is useful for the process of the present invention. In the illustrated embodiment, the printer includes six replaceable ink supply tanks 20 mounted in a removable ink jet cartridge 21. The ink supply tanks supply a developing composition, an oxidizing composition, a coloring composition containing a yellow dye coupler, a coloring composition containing a magenta dye coupler, a coloring composition containing a cyan dye coupler, and a fixing composition. In another embodiment (not shown), four replaceable ink supply tanks are provided, with one delivering a coloring composition, wherein the resulting images are monochrome. The removable cartridge is installed on a translatable carriage 22 which is supported by carriage guide rails 23 fixedly mounted in frame 24 of the printer. The removable cartridge is designed to consume or deplete the ink from at least ten ink supply tanks of the same color of ink. The carriage is translated back and forth along the guide rails by any suitable means (not shown), as well known in the printer industry, under the control of the printer controller (not shown). Referring also to FIG. 4, the multicolor, single printhead thermal ink jet cartridge 21 comprises a housing 25 having an integral multicolor ink jet printhead 26 and ink pipe connectors 27 which protrude from a wall 28 of the cartridge for insertion into the ink tanks when the ink tanks are installed in the cartridge housing. Ink flow paths, represented by dashed lines 29, in the cartridge housing interconnects each of the ink connectors with the separate inlets of the printhead. The ink jet cartridge, which comprises the replaceable ink supply tanks that contain ink for supplying ink to the printhead 26, includes an interfacing printed circuit board (not shown) that is connected to the printer controller by ribbon cable 30 through which electric signals are selectively applied to the printhead to selectively eject ink droplets from the printhead nozzles (not shown). The multicolor printhead 26 contains a plurality of ink channels (not shown) which carry ink from each of the ink tanks to respective groups of ink ejecting nobles of the printhead.

When printing, the carriage 22 reciprocates back and forth along the guide rails 23 in the direction of arrow 31. As the printhead 26 reciprocates back and forth across a recording medium 32, such as single cut sheets of paper which are fed from an input stack 33 of sheets, droplets of ink are expelled from selected ones of the printhead nozzles towards the recording medium 32. The nozzles are typically arranged in a linear array perpendicular to the reciprocating direction of arrow 34. During each pass of the carriage 22, the recording medium 32 is held in a stationary position. At the end of each pass, the recording medium is stepped in the direction of arrow 34.

A single sheet of recording medium 32 is fed from the input stack 33 through the printer along a path defined by a curved platen 34*a* and a guide member 35. The sheet is driven along the path by a transport roller 36 as is understood by those skilled in the art or, for instance, as illustrated in U.S. Pat. No. 5,534,902, the disclosure of which is totally incorporated herein by reference. As the recording medium exits a slot between the platen 34 and guide member 35, the sheet 32 is caused to reverse bow such that the sheet is supported by the platen 34*a* at a flat portion thereof for printing by the printhead 26.

With continued reference to FIG. 4, ink from each of the ink supply tanks 20 is drawn by capillary action through the outlet port 37 in the ink supply tanks, the ink pipe connectors 38, and ink flow paths 29 in the cartridge housing to the printhead 26. The ink pipe connectors and flow paths of the cartridge housing supplies ink to the printhead ink channels, replenishing the ink after each ink droplet ejection from the nozzle associated with the printhead ink channel. It is important that the ink at the nozzles be maintained at a slightly negative pressure, so that the ink is prevented from dripping onto the recording medium 32, and ensuring that ink droplets are placed on the recording medium only when a droplet is ejected by an electrical signal applied to the heating element in the ink channel for the selected nozzle. A negative pressure also ensures that the size of the ink droplets ejected from the nozzles remain substantially constant as ink is depleted from the ink supply tanks. The negative pressure is usually in the range of −0.5 to −5.0 inches of water. One known method of supplying ink at a negative pressure is to place within the ink supply tanks an open cell foam or needled felt in which ink is absorbed and suspended by capillary action. Ink tanks which contain ink holding material are disclosed, for example, in U.S. Pat. No. 5,185,614, U.S. Pat. No. 4,771,295, and U.S. Pat. No. 5,486,855, the disclosures of each of which are totally incorporated herein by reference.

Figure 5:
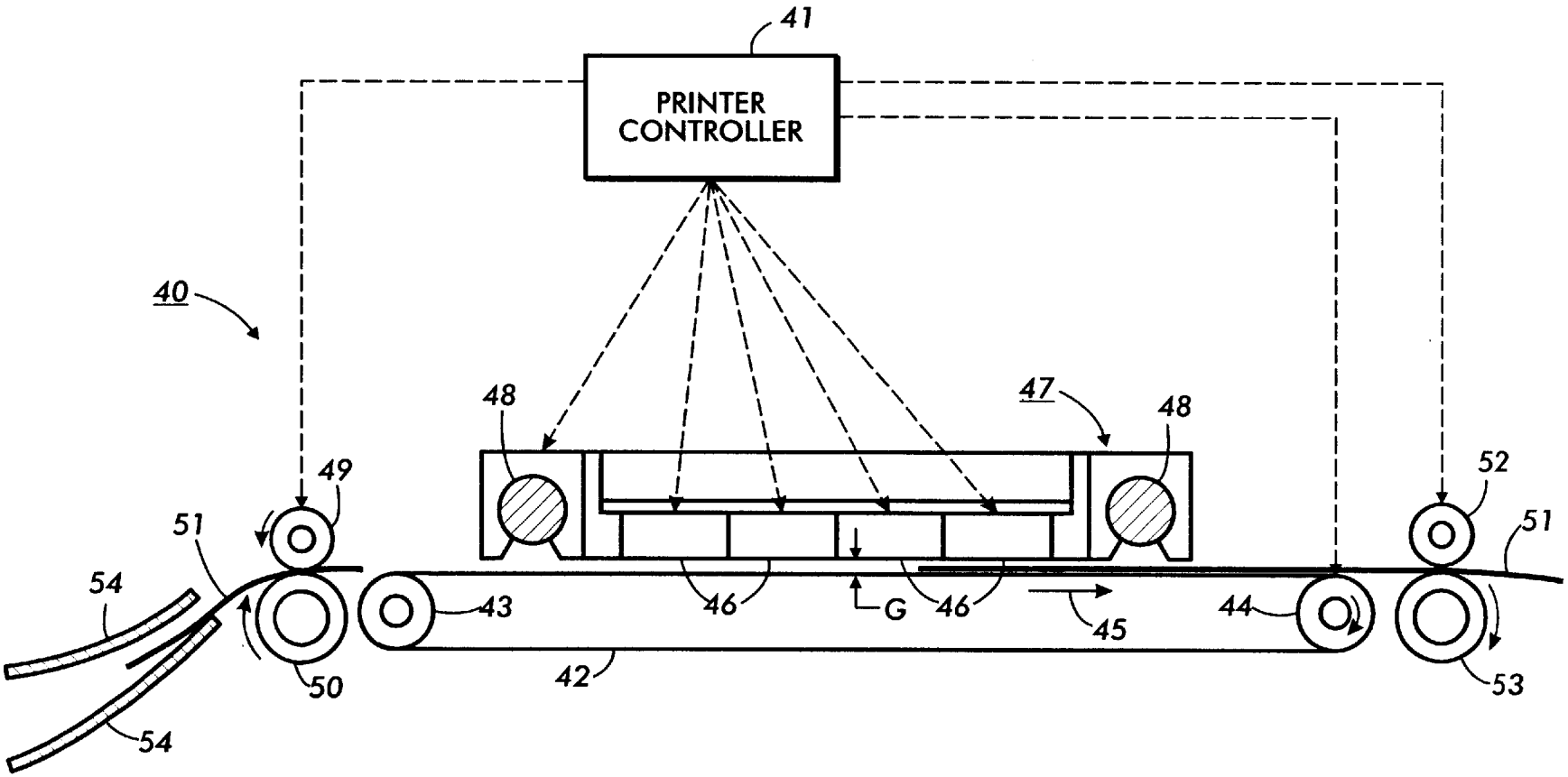
FIG. 5 is a schematic, partially shown side elevation view of an acoustic ink jet printer useful for the present invention.

In FIG. 5, a partially shown side elevation view of an acoustic ink jet printer 40 is depicted. The printer has a printer controller 41, a transport belt 42 entrained on idler roller 43 and drive roller 44 for movement in the direction of arrow 45, a plurality of acoustic ink jet printheads 46 mounted on a carriage 47 which is translatable along guide rails 48 in a direction orthogonal to the direction of the printhead carriage, and a pair of input feed rollers 49 and 50 forming a nip therebetween for registering and feeding a recording medium 51, such as a sheet of paper, on to the transport belt. A pair of output feed rollers 52 and 53 drive the recording medium from the transport belt, so that the recording medium is always in the grip of either the feed rollers or the output rollers.

The printer controller 41 directly communicates with and controls the input feed rollers 49 and 50, which accept the recording medium from the input tray (not shown) after the recording medium exits from a pair of guides 54 which direct the recording medium to the input feed rollers. Printer controller 41 also directly communicates with and controls the movement of the transport belt via a stepper motor (not shown). In the illustrated embodiment, the acoustic ink jet printheads are translatable, partial width printheads, one printhead for each of the liquids to be dispensed onto the recording medium, and the transport belt is held stationary by the printer controller while the printheads print a swath of an image. The transport belt is then stepped a distance equal to the height of the printed swath or a portion thereof until the entire image is printed. Other embodiments are possible, including an embodiment in which the printheads are pagewidth and fixed and the transport belt is moved relative to the printheads at a constant velocity. The printer controller 41 directly communicates with and controls the acoustic ink droplet ejectors 55 (see FIG. 6) in each of the acoustic printheads.

Figure 6:
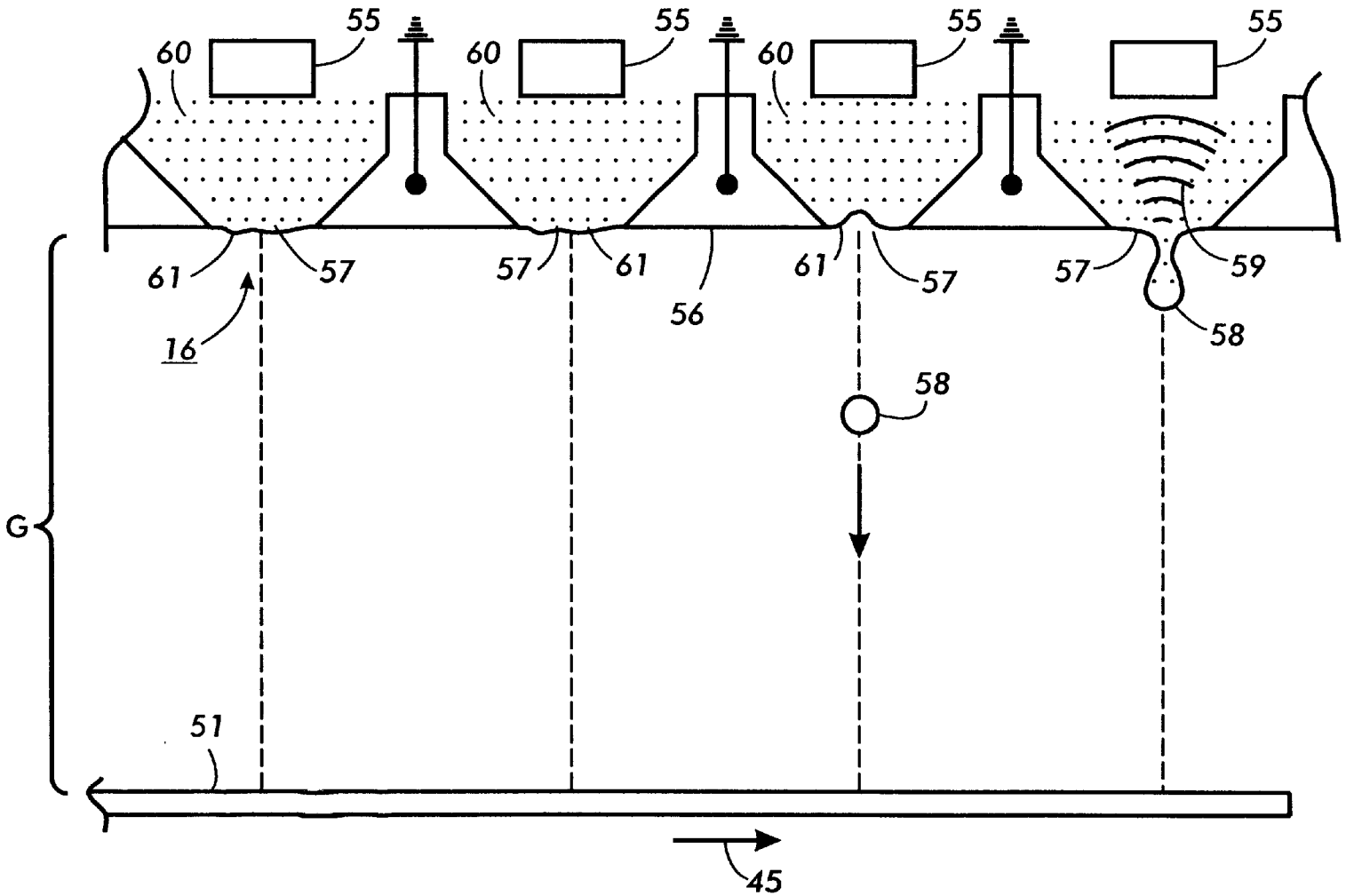
FIG. 6 is a schematic representation of an acoustic ink jet printhead used in the apparatus of FIG. 5 and showing ink droplets moving toward a recording medium on the transport belt.

Referring to FIG. 6, a schematic representation of the apparatus is shown in an enlarged cross-sectional view of a portion of the printhead 46, the transport belt 42 with the recording medium 51 thereon, and the gap "G" between the face 56 of the printhead having the apertures 57 therein and the transport belt. The printhead 46 ejects ink droplets 58 through the printhead apertures 57 directed toward the recording medium 51 using acoustic ink droplet ejectors 55. Each acoustic ink droplet ejector includes a piezoelectric transducer of RF source which creates a sound wave 59 in the ink 60 stored in the printhead. A lens (not shown), such as a Fresnel lens, focuses the sound wave at the ink surface 61 in the apertures 57. The acoustic pressure at the ink surface 61 causes an ink droplet 58 to form. The fully formed and ejected droplet 58 is directed and propelled towards the recording medium 51.

Figure 7:
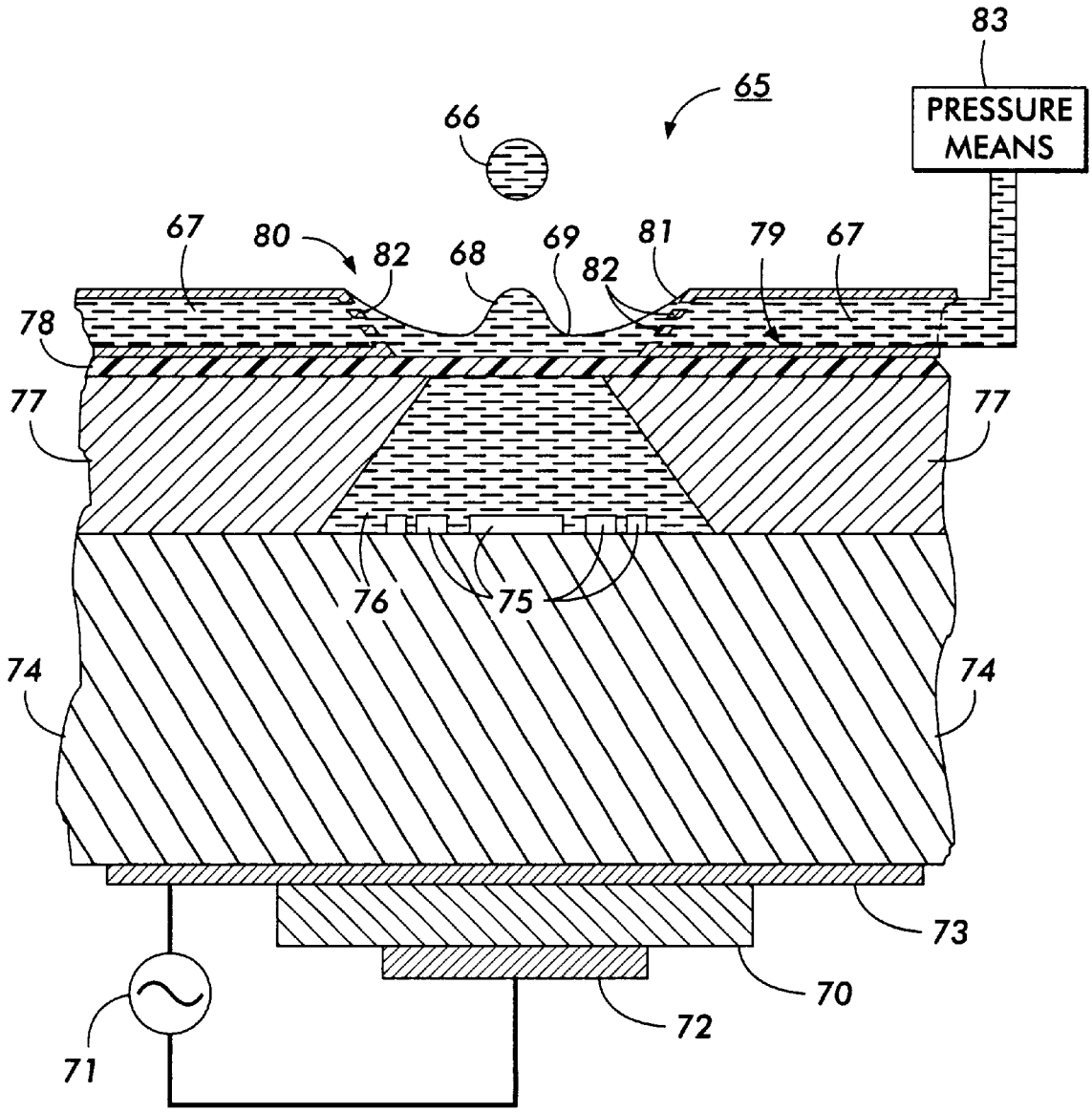
FIG. 7 is an unscaled, cross-sectional view of a first embodiment acoustic droplet ejector which is shown ejecting a droplet of a marking fluid.

Refer now to FIG. 7 for an illustration of an exemplary acoustic droplet ejector 65. FIG. 7 shows the droplet ejector 65 shortly after ejection of a droplet 66 of marking fluid 67 and before the mound 68 on the free surface 69 of the marking fluid 67 has relaxed. As droplets are ejected from such mounds, mound relaxation and subsequent formation are prerequisites to the ejection of other droplets.

The forming of the mound 68 and the ejection of the droplet 66 are the results of pressure exerted by acoustic forces created by a ZnO transducer 70. To generate the acoustic pressure, RF drive energy is applied to the ZnO transducer 70 from an RF driver source 71 via a bottom electrode 72 and a top electrode 73. The acoustic energy from the transducer passes through a base 74 into an acoustic lens 75. The acoustic lens focuses its received acoustic energy into a small focal area which is at, or is near, the free surface 69 of the marking fluid 67. Provided that the energy of the acoustic beam is sufficient and properly focused relative to the free surface 69 of the marking fluid, a mound 68 is formed and a droplet 66 is ejected.

Suitable acoustic lenses can be fabricated in many ways, for example, by first depositing a suitable thickness of an etchable material on the substrate. Then, the deposited material can be etched to create the lenses. Alternatively, a master mold can be pressed into the substrate at the location where the lenses are desired. By heating the substrate to its softening temperature acoustic lenses are created.

Still referring to FIG. 7, the acoustic energy from the acoustic lens 75 passes through a liquid cell 76 filled with a liquid (such as water) having a relatively low attenuation. The bottom of the liquid cell 76 is formed by the base 74, the sides of the liquid cell are formed by surfaces of an aperture in a top plate 77, and the top of the liquid cell is sealed by an acoustically thin capping structure 78. By "acoustically thin" it is implied that the thickness of the capping structure is less than the wavelength of the applied acoustic energy.

The droplet ejector 65 further includes a reservoir 79, located over the capping structure 78, which holds marking fluid 67. As shown in FIG. 7, the reservoir includes an opening 80 defined by sidewalls 81. It should be noted that the opening 80 is axially aligned with the liquid cell 76. The side walls 81 include a plurality of portholes 82 through which the marking fluid passes. A pressure means 83 forces marking fluid 67 through the portholes 82 so as to create a pool of marking fluid having a free surface over the capping structure 78.

The droplet ejector 65 is dimensioned such that the free surface 69 of the marking fluid is at, or is near, the acoustic focal area. Since the capping structure 78 is acoustically thin, the acoustic energy readily passes through the capping structure and into the overlaying marking fluid.

A droplet ejector similar to the droplet ejector 65, including the acoustically thin capping structure and reservoir, is described in U.S. patent application Ser. No. 890,211, filed by Quate et. al. on May 29, 1992, now abandoned, the disclosure of which is totally incorporated herein by reference.

Figure 8:
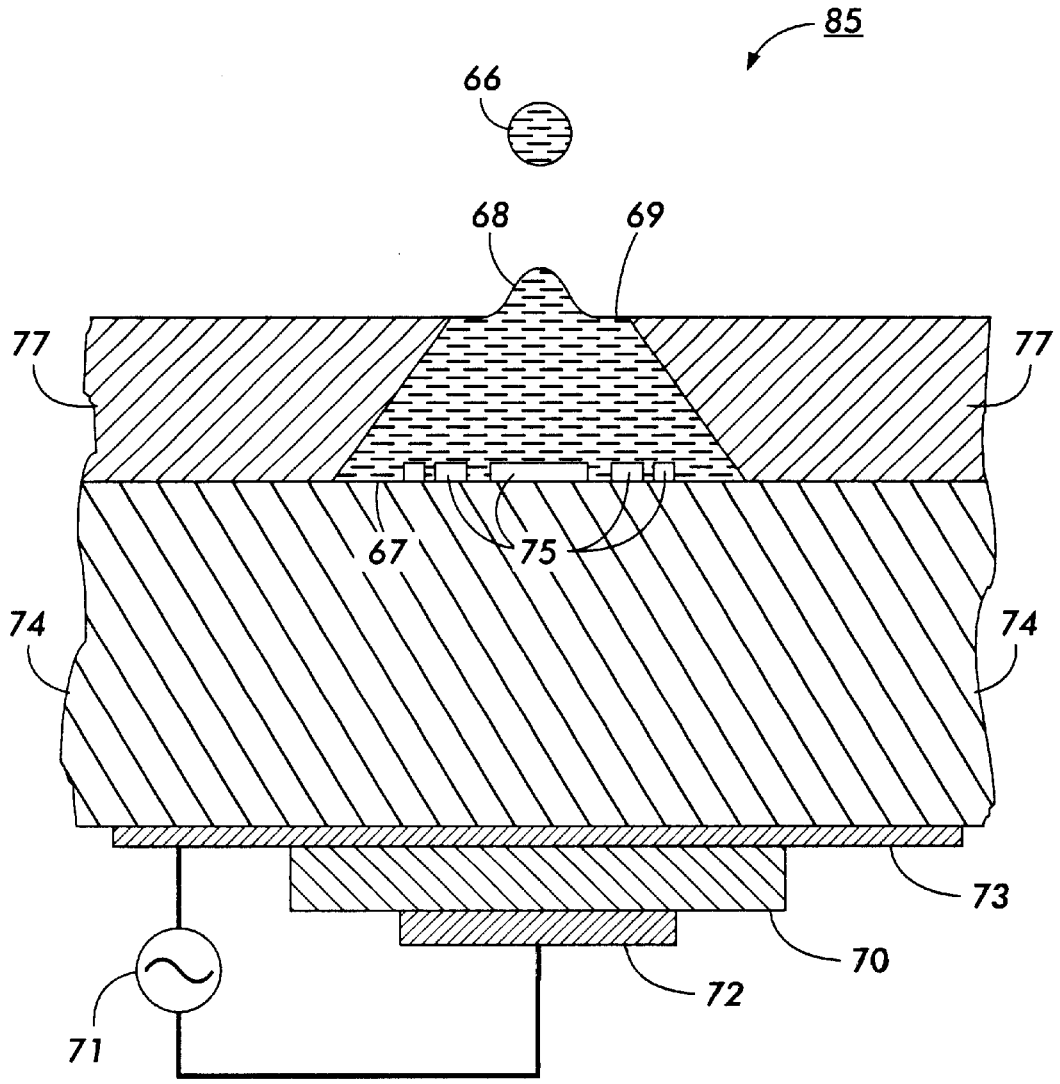
FIG. 8 is an unscaled cross-sectional view of a second embodiment acoustic droplet ejector which is shown ejecting a droplet of a marking fluid.

A second embodiment acoustic droplet ejector 85 is illustrated in FIG. 8. The droplet ejector 85 does not have a liquid cell 76 sealed by an acoustically thin capping structure 78. Nor does it have the reservoir filled with marking fluid 67 nor any of the elements associated with the reservoir. Rather, the acoustic energy passes from the acoustic lens 75 directly into marking fluid 67. However, droplets 66 are still ejected from mounds 68 formed on the free surface 69 of the marking fluid.

Figure 9:
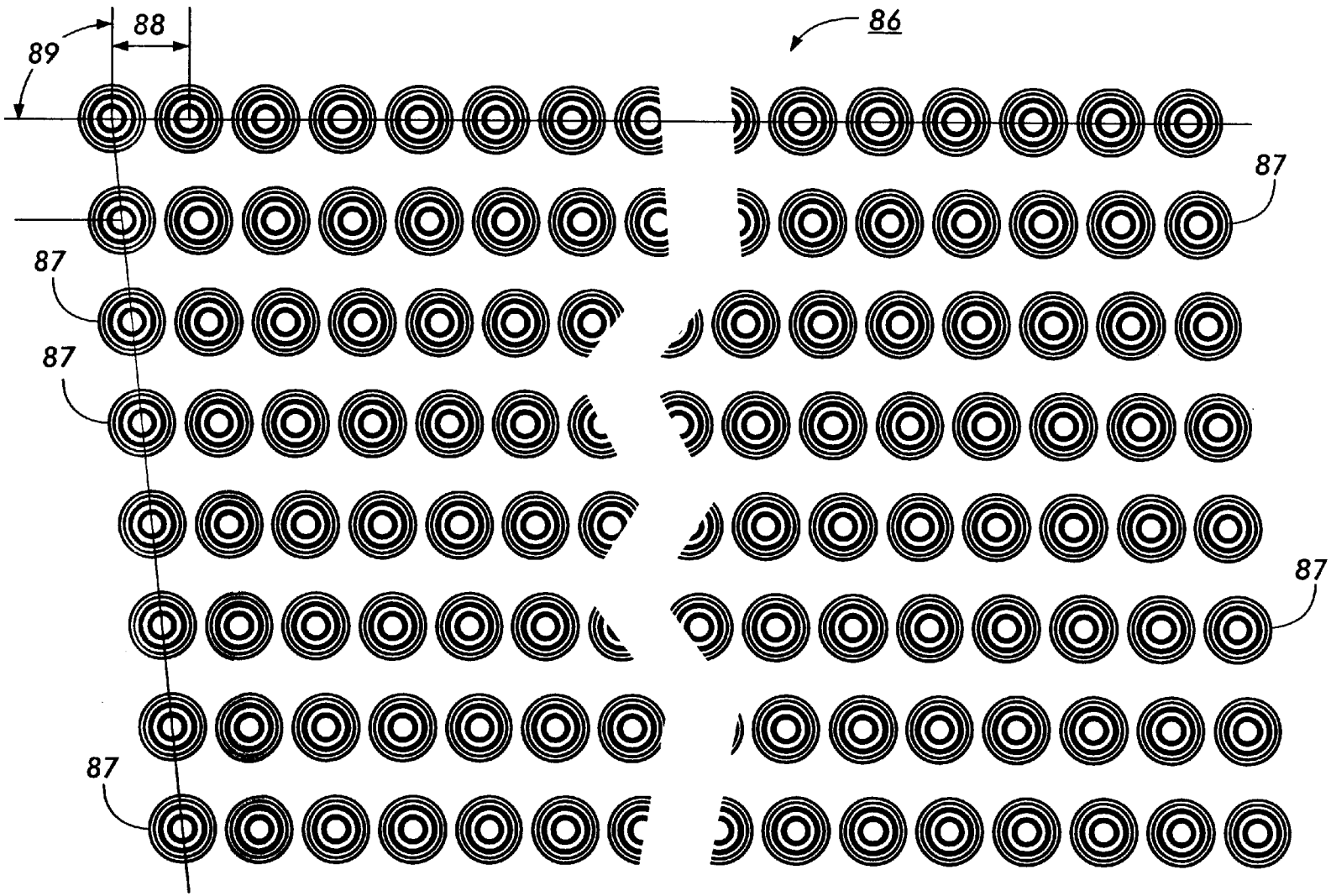
FIG. 9 is an top-down schematic depiction of an array of acoustic droplet ejectors in one ejector unit.

The individual acoustic droplet ejectors 65 and 85(illustrated in FIGS. 7 and 8, respectively) are usually fabricated as part of an array of acoustic droplet ejectors. FIG. 9 shows a top-down schematic depiction of an array 86 of individual droplet ejectors 87 which is particularly useful in printing applications. Since each droplet ejector 87 is capable of ejecting a droplet with a smaller radius than the droplet ejector itself, and since full coverage of the recording medium is desired, the individual droplet ejectors are arrayed in offset rows. In FIG. 9, each droplet ejector in a given row is spaced a distance 88 from its neighbors. That distance 88 is eight (8) times the diameter of a droplet ejected from a droplet ejector. By offsetting eight (8) rows of droplet ejectors at an angle 89, and by moving the recording medium relative to the rows of droplet ejectors at a predetermined rate, the array 100 can print fully filled in (no gaps between pixels) lines or blocks.

Figure 10:
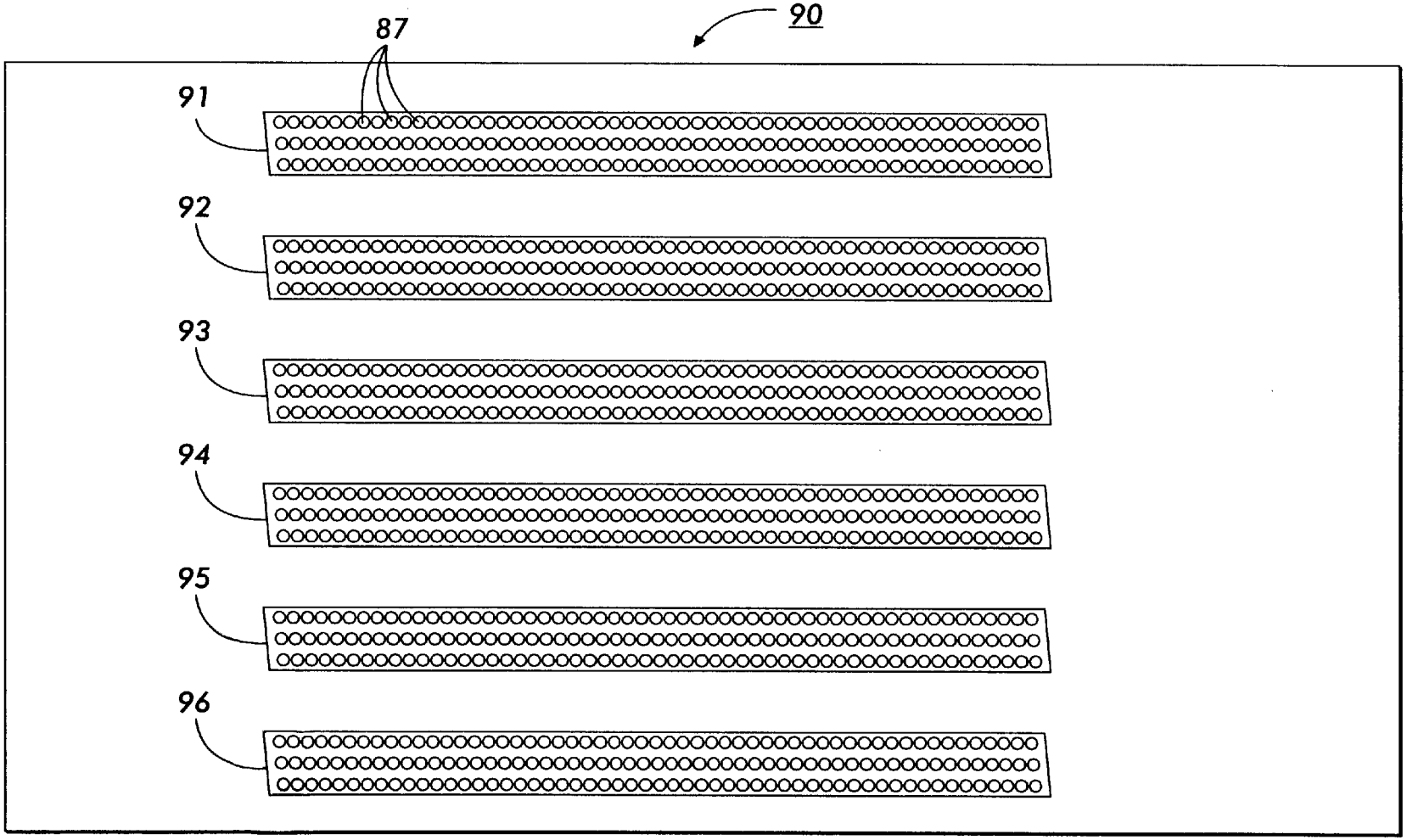
FIG. 10 is a top-down schematic view of the organization of a plurality of ejector units in a color printhead.

FIG. 9 illustrates an array of droplet ejectors capable of single pass printing of one color of marking fluid, i.e., one ejection unit. Multiple ejection units, each capable of ejecting a different material, can be contained in a single material deposition head. FIG. 10 schematically depicts a material deposition head 90 comprising six arrays, designated arrays 91, 92, 93, 94, 95, and 96, each similar to the array 86 shown in FIG. 9 (except that, for clarity, only three rows of droplet ejectors 87 are shown). While in many applications the distance between each of the arrays will be the same, such is not required.

The benefit of a material deposition head such as material deposition head 90 is readily apparent. By forming multiple arrays, each capable of printing a different fluid, and by moving the recording medium relative to the material deposition head at a controlled rate, and by timing the ejection of each array correctly, registration of the printed liquids can be readily achieved.

Figure 11:
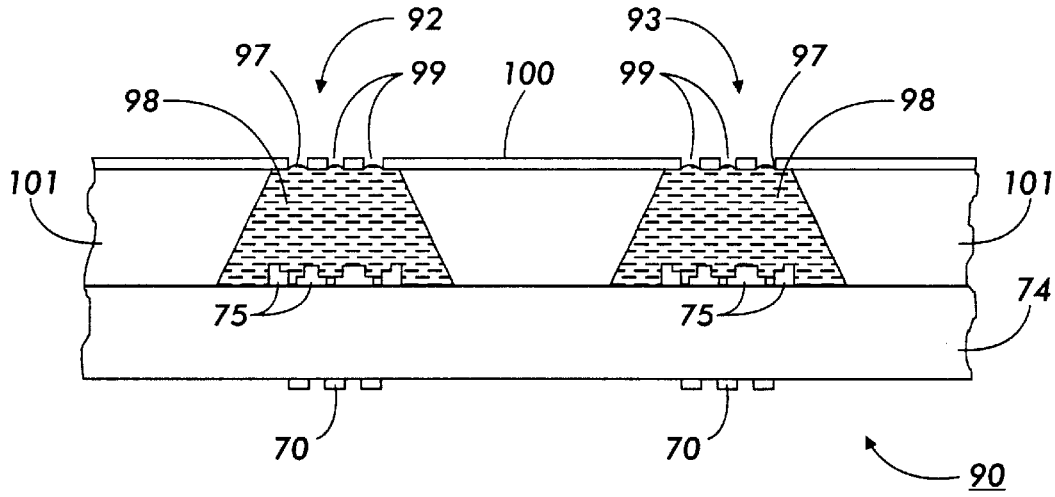
FIG. 11 is a cross-sectional view of one embodiment of the present invention, a material deposition head having multiple ejection units.
Figure 12:
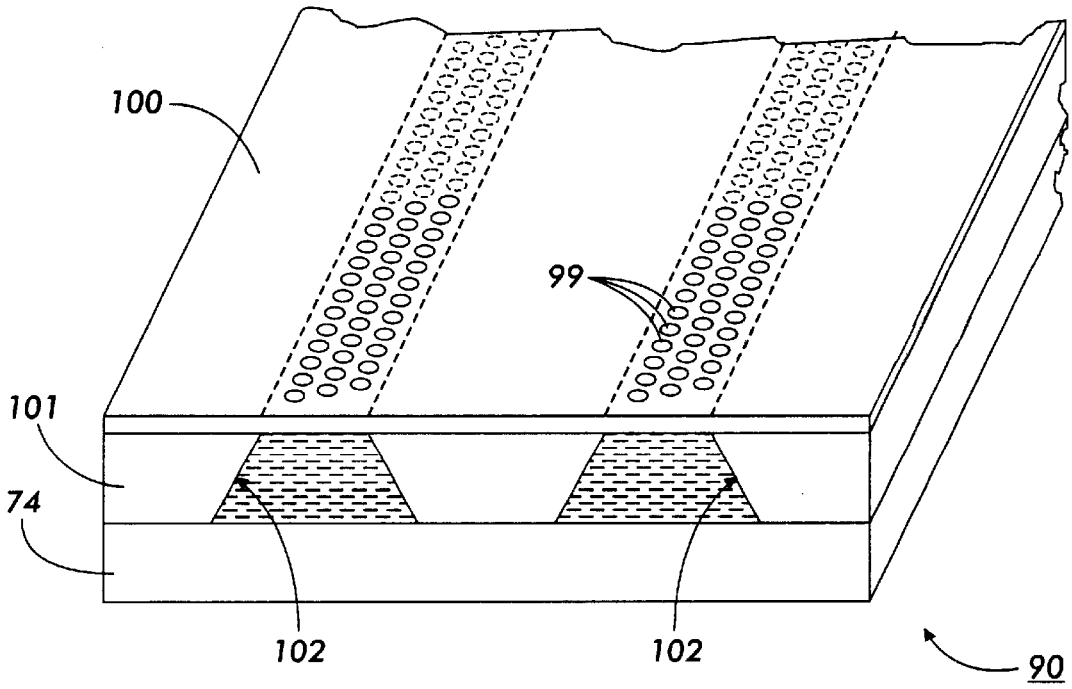
FIG. 12 is a perspective view of the structure of FIG. 11.

A cross-sectional, simplified (again, only three rows of the eight rows of each ejection unit, and only two of the six ejection units) depiction of the material deposition head 90, with the arrays 92 and 93, is shown in FIG. 11. The other arrays are not shown, but are understood as being off to the left and right. As shown, the free surface 97 of the material 98 is contained within apertures 99 that are defined in a thin plate 100 which is over a support 101. FIG. 12, a perspective view of FIG. 11, better illustrates the apertures 99. It is to be understood that each material 98 is confined in a chamber defined by a channel 102 and the base. The individual droplet ejectors each align with an associated aperture 99 which is axially aligned with that droplet ejector's acoustic lens 75 (see also FIGS. 7 and 8). Droplets are ejected from the free surface 97 through the apertures. The support 101 is directly bonded to a glass base 28.

It is to be noted that FIGS. 11 and 12 and the subsequent text and associated drawings all describe and illustrate individual droplet ejectors according to FIG. 8. It should be noted that droplet ejectors according to FIG. 7 are also suitable for use in the apparatus illustrated in FIGS. 11 and 12.

Figure 13:
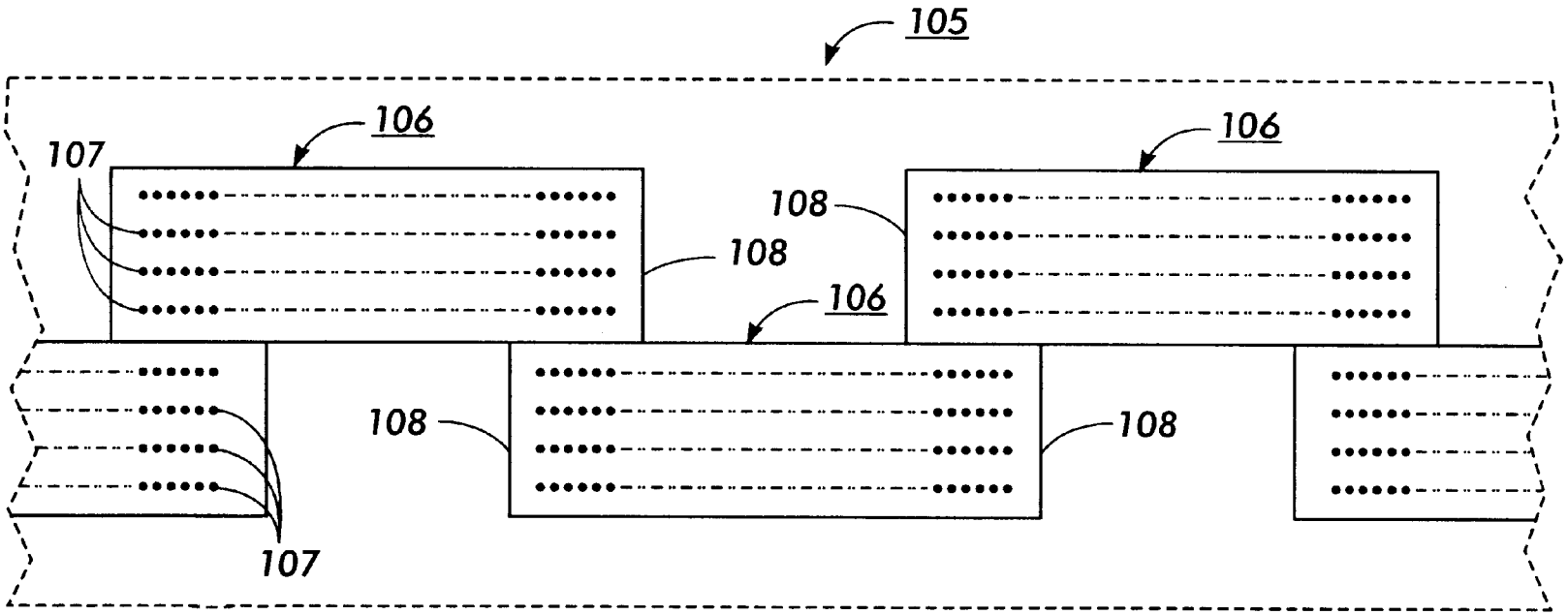
FIG. 13 is a schematic front elevation view of a portion of an extended width or full width printhead which has been assembled from a plurality of partial width array thermal ink jet or acoustic ink jet printheads.

In FIG. 13, a schematic front view of a portion of a multifluid printhead 105 is shown in dashed line. The printhead 105 comprises a plurality of partial width array printheads 106 assembled in at least two parallel rows. Each partial width array printhead has at least four rows of nozzles 107 or, in the case of the nozzleless acoustic ink jet printheads disclosed, for example, in U.S. Pat. No. 4,697,195, the partial width array printhead has at least four rows of droplet ejecting locations 107. Each row of nozzles or droplet ejecting locations 107 eject a developing composition, an oxidizing composition, a coloring composition containing a yellow dye coupler, a coloring composition containing a magenta dye coupler, a coloring composition containing a cyan dye coupler, or a fixing composition. In another embodiment (not shown), four rows of nozzles are provided, with one delivering a coloring composition, wherein the resulting images are monochrome. In the illustrated embodiment, the partial width array printheads in each of the two rows are equally spaced from each other and the partial width array printheads in one row are offset from the partial width array printheads in the other row, with the end portions 108 of adjacent partial width array printheads in the two different rows overlapping each other. Each partial width array printhead 106 has an equal number of droplet ejecting locations or nozzles 107 per row and an equal number of droplet ejecting locations or nozzles per printhead. A sufficient number of staggered partial width array printheads 106 are assembled to provide for extended width printing or page width printing, and when sufficient for page width printing, such a printhead is referred to as a full width array printhead. An extended width array printhead is one which has a plurality of partial width array printheads but the rows of such printheads do not contain enough partial width array printheads to print across the width of a page. An extended width array printhead functions similarly to a partial width array printhead, but is able to print a larger swath of information.

In all of the above printing apparatus illustrated in FIGS. 1 through 13, it will be appreciated that the number of liquids applied to the substrate, and accordingly the number of ink supplies or containers, can be varied as desired. For example, for monochrome printing, the printer will apply to the substrate four liquids, namely a developing composition, an oxidizing composition, a fixing composition, and the coloring composition of the desired color. In multicolor printing, black may be applied in addition to cyan, magenta, and yellow, and the printer will apply to the substrate seven liquids, namely a developing composition, an oxidizing composition, a fixing composition, and the cyan, magenta, yellow, and black coloring compositions.

Additional examples of suitable printing apparatus for the present invention are disclosed in, for example, U.S. Pat. No. 5,568,169, U.S. Pat. No. 5,565,113, U.S. Pat. No. 5,596,355, U.S. Pat. No. 5,371,531, U.S. Pat. No. 4,797,693, U.S. Pat. No. 5,198,054, copending application U.S. Ser. No. 08/946,935, copending application U.S. Ser. No. 08/883,988, copending application U.S. Ser. No. 08/965,316, and copending application U.S. Ser. No. 08/820,624, the disclosures of each of which are totally incorporated herein by reference.

Any order of deposition of dye coupler, developer, and oxidizing agent can be employed; typically, the selected order is dependent on the specific reagents employed and their formulations. Fixative is always deposited last. In one embodiment of the present invention, the timing of the deposition of the fixative determines the color intensity. When developer, coupler, and oxidizer come together, the reaction to form the dye starts. The intensity of the color depends on the amount of dye formed. Deposition of the fixative at different times along the reaction profile stops the dye forming reactions, and the amount of dye formed at that moment in time determines the color tone or intensity. Developer and coupler can usually be deposited without regard to time. Once oxidizer and developer come together, however, the timing of deposition of coupler and fixative becomes more important, because the oxidized developer is highly reactive and should be reacted with the coupler relatively soon after its formation.

In one embodiment of the present invention, a multiplicity of intensity or "gray" levels within a particular color can be obtained by controlling the time between the point at which the developing composition, oxidizing composition, and coloring composition all come together and the point at which the fixing composition is deposited. The reaction between the dye coupler and the oxidized developer can be halted at a point short of maximum color intensity, thereby creating one or more "gray" levels of color.

In another embodiment of the present invention, a multiplicity of intensity or "gray" levels within a particular color can be obtained by jetting fixed amounts of developing composition and coloring composition onto the substrate in combination with varying amounts of oxidizing composition, with the oxidizing agent in the oxidizing composition being present in reaction limiting quantities with respect to the color developer in the developing composition and the dye coupler in the coloring composition. More specifically, the printhead for jetting the oxidizing composition can have a multiplicity of channels, each of which jet a different volume of oxidizing compound, as required. Alternatively, the printhead for jetting the oxidizing composition can jet drops of very small volume, and multiple small drops of oxidizing composition can be deposited at a given pixel location, depending on the intensity or "darkness" or saturation of color desired at that pixel location. High resolution gray level printing can thus be obtained without loss of throughput speed, which might otherwise be associated with gray level ink jet printing processes. Alternatively, instead of varying the amount or volume of oxidizing composition, the amount or volume of developing composition and/or the amount or volume of coloring composition can be varied by the above methods to obtain gray level prints.

Figure 14:
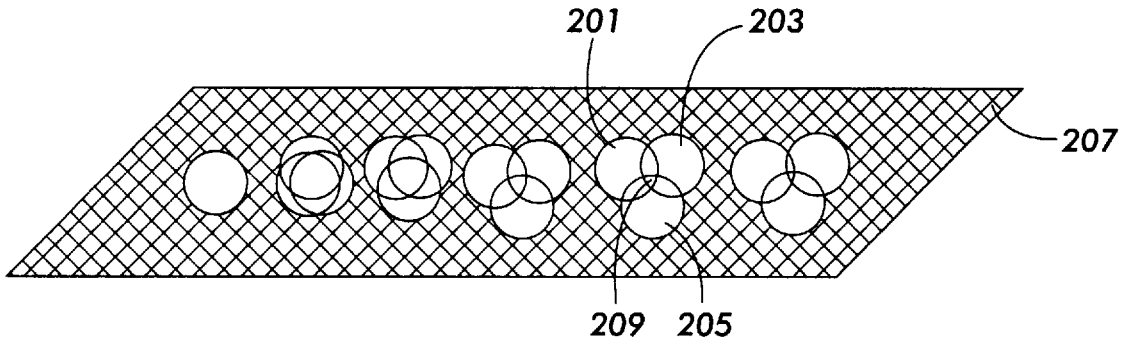
FIG. 14 illustrates schematically a process of the present invention wherein gray scale images are generated by overlapping droplets.

In yet another embodiment of the present invention, high resolution and gray scale images can be generated by generating spots of varying sizes on the substrate. More specifically, the developing composition, coloring composition(s), and oxidizing composition are jetted in an imagewise pattern so that the overlap of droplets of these three compositions is controlled. Pixel size can thereby be modulated to realize variable spot sizes, and high resolution gray level printing can thus be obtained without loss of throughput speed which might otherwise be associated with gray level ink jet printing processes. As illustrated schematically in FIG. 14, the developer composition droplets 201, the oxidizing composition droplets 203, and the coloring composition droplets 205 can be jetted onto the substrate 207 with varying amounts of overlap 209, thereby forming image areas of varying size. In a full color printing process, three coloring compositions are employed to form varying size image areas of, for example, cyan, magenta, and yellow.

The developing composition generally comprises a liquid vehicle and a color developer or developing agent, and functions as a color forming component in the process of the present invention. For the purpose of simplicity, the developing composition will at times hereinafter be referred to as an ink. Any liquid can be employed as the major component of the liquid vehicle, provided that it dissolves or disperses the components of the composition and is of a viscosity appropriate for the selected drop ejector. For example, in thermal ink jet printing systems, a preferred liquid vehicle is water. In other drop ejectors, such as those employing continuous stream processes, piezoelectric ink jet printers, acoustic ink jet printers, and the like, other liquids can also be employed, such as hydrocarbons, glycols, ethers, sulfones such as sulfolane, pyrrolidinones such as 2-pyrrolidinone and N-methyl pyrrolidinone, other dipolar aprotic solvents, and the like, as well as mixtures thereof. The developing composition can also contain other components which might improve its performance as an ink jet ink, such as humectants, penetrants, cosolvents, jetting aids, or the like, set forth in more detail hereinbelow. The developing composition typically contains the color developer in an amount of from about 0.05 to about 15 percent by weight of the developing composition, preferably from about 0.1 to about 10 percent by weight of the developing composition, and more preferably from about 0.5 to about 5 percent by weight of the developing composition, although the amount can be outside of these ranges.

Examples of color developers or developing agents include phenylenediamines, of the formulae

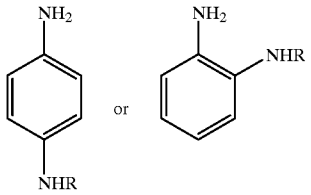

wherein R is a hydrogen atom, an alkyl group, preferably with from 1 to about 4 carbon atoms, or a substituted alkyl group, wherein the benzene ring can be substituted, and wherein 2 or more substituents can be joined together to form additional rings, such as p-phenylenediamine, of the formula

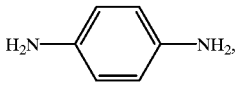

o-phenylenediamine, of the formula

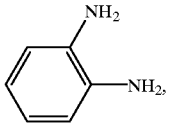

monomethyl-p-phenylenediamine, of the formula

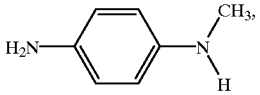

and the like. Particularly preferred as color developers are N,N-dialkyl-p-phenylenediamines, of the general formula

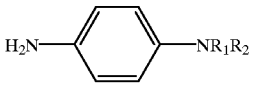

wherein each of $R_1$ and $R_2$, independently of the other, is an alkyl group, preferably with from 1 to about 4 carbon atoms, or a substituted alkyl group, wherein the benzene ring can be substituted, and wherein 2 or more substituents can be joined together to form additional rings. Specific examples of N,N-dialkyl-p-phenylenediamines include N,N-dimethyl-p-phenylenediamine, of the formula

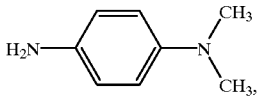

N,N-diethyl-p-phenylenediamine, of the formula

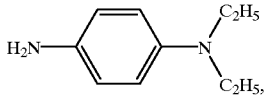

N,N-diethyl-p-phenylenediamine hydrochloride, of the formula

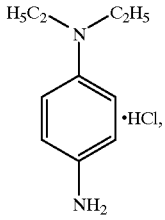

N,N-diethyl-p-phenylenediamine hemisulfate, of the formula

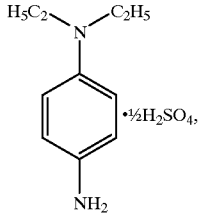

N,N-diethyl-p-phenylenediamine sulfur dioxide complex, of the formula

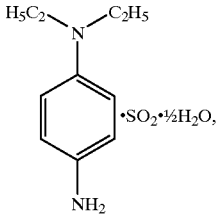

N,N-diethyl-toluene-2,5-diamine hydrochloride, of the formula

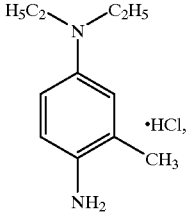

2-(p-amino-N-ethylanilino)ethanol sulfate, of the formula

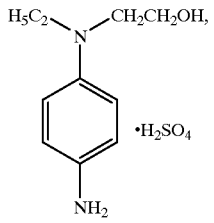

N-ethyl-N-(β-methanesulphonamidoethyl)-4-aminoaniline, of the formula

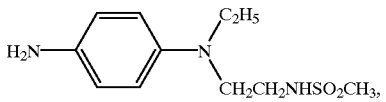

N-(2-(4-amino-N-ethyl-m-toluidino)ethyl)-methanesulfonamide sesquisulfate hydrate, of the formula

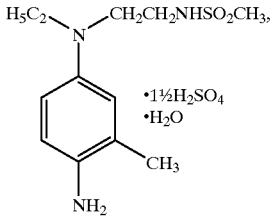

2-((4-amino-m-tolyl)ethylamino)ethanol sulfate, of the formula

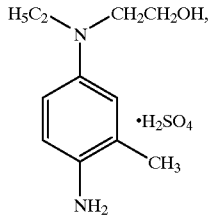

4-(N-ethyl-N-2-methane sulfonylaminoethyl)-2-methylphenylene diamine sesquisulfate, of the formula

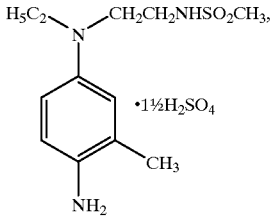

and the like. The latter is particularly preferred because, as a function of pH, it can exist in cationic and zwitterionic forms and both forms can react with an ionized dye coupler, albeit at different rates. Also suitable are hydroquinones, of the formula

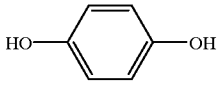

wherein the benzene ring can be substituted, and wherein 2 or more substituents can be joined together to form additional rings, such as hydroquinone, of the formula

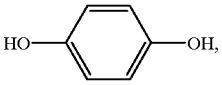

chlorohydroquinone, of the formula

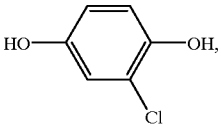

bromohydroquinone, of the formula

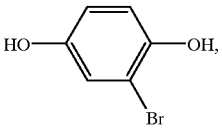

toluhydroquinone, of the formula

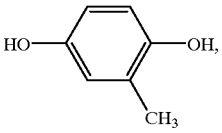

methoxyhydroquinone, of the formula

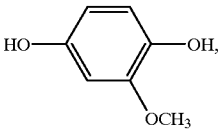

and the like, catechol, of the formula

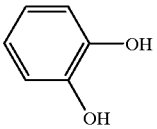

and its derivatives, such as pyrogallol, of the formula

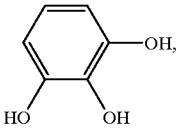

4-phenyl catechol, of the formula

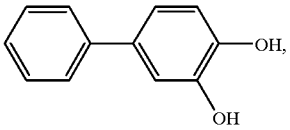

gallic acid, of the formula

-continued

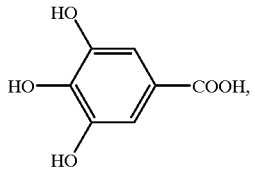

methyl gallate, of the formula

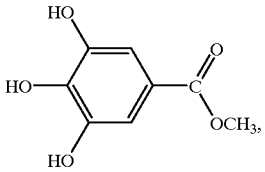

gallacetophenone, of the formula

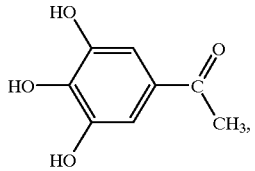

methyl ester of gentisic acid, of the formula

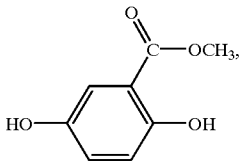

daphnetin, of the formula

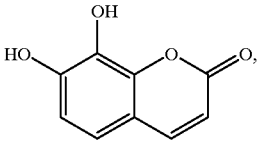

5,8-methano-5,6,7,8-tetrahydro-1,4-dihydroxynaphthalene, of the formula

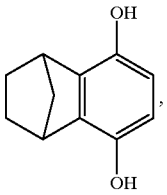

and the like. Also suitable are p-aminophenols, of the general formula

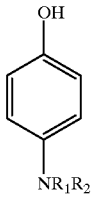

wherein $R_1$ and $R_2$ each, independently of the other, are hydrogen atoms, alkyl groups, preferably with from 1 to about 4 carbon atoms, or substituted alkyl groups, wherein the benzene ring can be substituted, and wherein 2 or more substituents can be joined together to form additional rings, such as p-aminophenol, of the formula

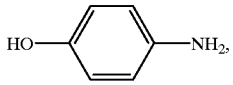

o-aminophenol, of the formula

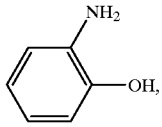

2-methyl-p-aminophenol, of the formula

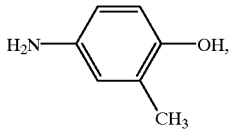

2-hydroxymethyl-p-aminophenol, of the formula

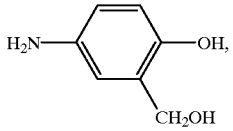

1-amino-2-naphthol-6-sulfonic acid (Eikonogen), of the formula

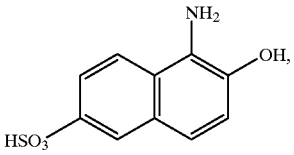

1-amino-2-naphthol-3,6-disulfonic acid (Diogen), of the formula

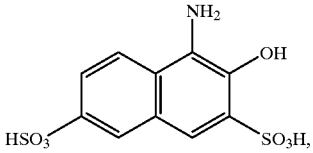

4-aminophenol hydrochloride, of the formula

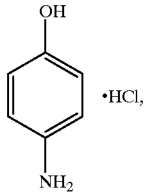

N-methyl-p-aminophenol (Metol), of the formula

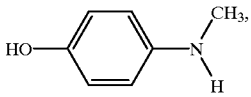

2,4-diaminophenol (Amidol), of the formula

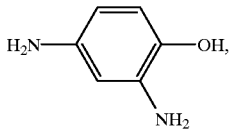

2,4-diaminophenol dihydrochloride, of the formula

-continued

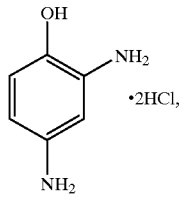

2,3,4-triaminophenol, of the formula

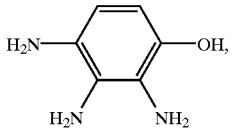

Triamol, of the formula

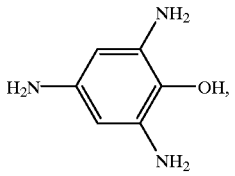

N-(4-hydroxyphenyl)glycine (Glycin), of the formula

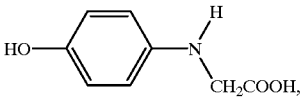

4-(hydroxyethylamino)-3-methyl-1-hydroxybenzene, of the formula

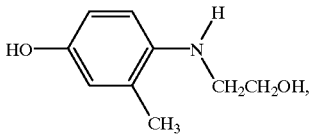

4-(di(hydroxyethyl)amino)-1-hydroxybenzene, of the formula

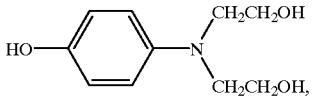

N-(2′-hydroxy-5′-aminobenzyl)-3-hydroxyaniline hydrochloride, of the formula

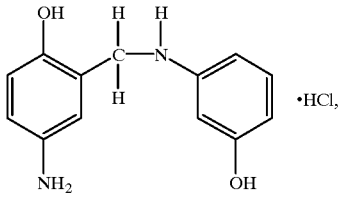

4-amino-2-benzylaminophenol, of the formula

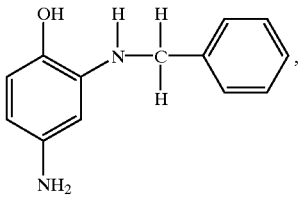

2-amino-4-(p-hydroxybenzylamino)-phenol, of the formula

-continued

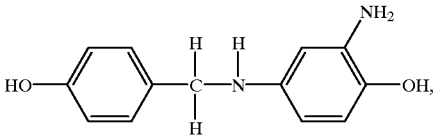

m-methyl-p-hydroxy-N-phenylmorpholine, of the formula

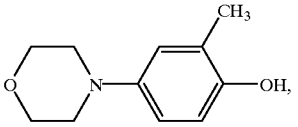

1-(4-hydroxyphenyl)-pyrrolidine, of the formula

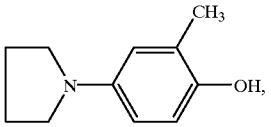

p-hydroxydiphenylamine (Duratol), of the formula

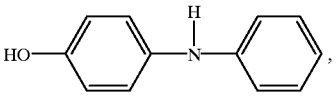

p-aminosalicyclic acid (Neol), of the formula

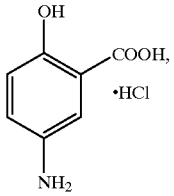

2-methyl-4-aminophenol hydrochloride (Monomet), of the formula

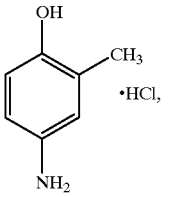

N-(hydroxyethyl)-o-aminophenol (Atomal), of the formula

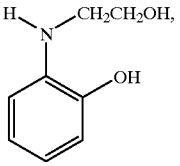

3-(hydroxymethyl)-4-hydroxyaniline hemisulfate (Edinol), of the formula

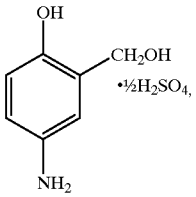

and the like; Diphenal, of the formula

-continued

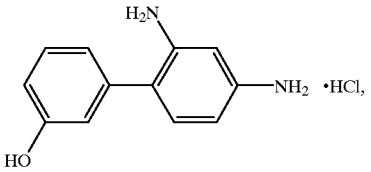

and the like. Mixtures of two or more developers can also be used. Commercially available examples of suitable developers include CD-2 [diethylamino-o-toluidine hydrochloride, CAS# 2051-79-8], CD-3 [4-(N-ethyl-N-2-methane sulfonylaminoethyl)-2-methylphenylene diamine sesquisulfate, CAS# 25646-71-3], and CD-4 [2-[(4-amino-m-tolyl)ethylamino]ethanol sulfate, CAS#25646-77-9], all available from Eastman Kodak Co., Rochester, N.Y., and the like. Further information regarding color developers is disclosed in, for example, *SPSE Handbook of Photographic Science and Engineering*, W. Thomas, Jr., ed., John Wiley & Sons (New York 1973); *Neblette's Handbook of Photography and Reprography,* 7th ed., J. Sturge, ed., Van Nostrand Reinhold Co. (New York 1977); *Modern Photographic Processing*, G. Haist, John Wiley & Sons (New York 1979); U.S. Pat. No. 477,486, U.S. Pat. No. 1,799,568, U.S. Pat. No. 1,712,716, U.S. Pat. No. 1,758,892, U.S. Pat. No. 1,758,762, U.S. Pat. No. 2,610,122, U.S. Pat. No. 2,385,763, U.S. Pat. No. 3,622,629, U.S. Pat. No. 3,762,922, U.S. Pat. No. 1,937,844, U.S. Pat. No. 3,265,499, U.S. Pat. No. 3,134,673, U.S. Pat. No. 3,091,530, U.S. Pat. No. 2,193,015, U.S. Pat. No. 2,688,549, U.S. Pat. No. 2,688,548, U.S. Pat. No. 2,691,589, U.S. Pat. No. 3,672,896, U.S. Pat. No. 2,289,367, U.S. Pat. No. 3,241,967, U.S. Pat. No. 3,330,839, U.S. Pat. No. 2,685,516, U.S. Pat. No. 2,852,374, U.S. Pat. No. 3,672,891, U.S. Pat. No. 1,939,231, U.S. Pat. No. 2,181,944, U.S. Pat. No. 3,459,549, U.S. Pat. No. 1,390,260, U.S. Pat. No. 1,663,959, U.S. Pat. No. 2,587,276, U.S. Pat. No. 2,857,275, U.S. Pat. No. 2,857,274, U.S. Pat. No. 3,293,034, U.S. Pat. No. 3,287,125, U.S. Pat. No. 3,287,124, U.S. Pat. No. 3,455,916, U.S. Pat. No. 2,843,481, U.S. Pat. No. 3,723,117, U.S. Pat. No. 2,596,978, U.S. Pat. No. 1,082,622, U.S. Pat. No. 2,220,929, U.S. Pat. No. 2,419,975, U.S. Pat. No. 2,685,514, U.S. Pat. No. 3,782,949, U.S. Pat. No. 853,643, U.S. Pat. No. 2,943,109, and U.S. Pat. No. 2,397,676; British Patent 1,191,535, British Patent 295,939, British Patent 1,210,417, British Patent 1,273,081, British Patent 1,003,783, British Patent 928,671, British Patent 989,383, British Patent 430,264, British Patent 767,700, British Patent 783,727, British Patent 542,502, British Patent 650,911, British Patent 679,677, British Patent 728,368, British Patent 757,271, British Patent 997,033, British Patent 761,301, British Patent 954,106, British Patent 679,678, British Patent 757,840, British Patent 459,665, British Patent 479,466, British Patent 1,122,085, British Patent 1,327,033, British Patent 1,191,535, British Patent 1,327,034, British Patent 1,327,035, British Patent 1,154,385, British Patent 943,928, British Patent 466,625, and British Patent 466,626; French Patent 1,480,920, French Patent 1,380,163, and French Patent 325,385; German Patent 945,606, German Patent 955,025, German Patent 158,741, German Patent 875,048, German Patent 870,418, German Patent 945,606, German Patent 1,151,175, German Patent 1,047,618, German Patent 1,079,455, German Patent 34,342, German Patent 36,746, and German Patent 97,596; Canadian Patent 931,009; the disclosures of each of which are totally incorporated herein by reference.

In silver halide development processes, the developer generally is oxidized by interaction with the silver halide in the film. For the instant invention, the developer is reacted with an oxidant or oxidizing agent. The developer, upon oxidation, is converted to a form capable of reacting with a dye coupler to form a dye. For example, a developer of the N,N-dialkyl-p-phenylenediamine class, upon oxidation, is converted to the quinone diimine, as follows:

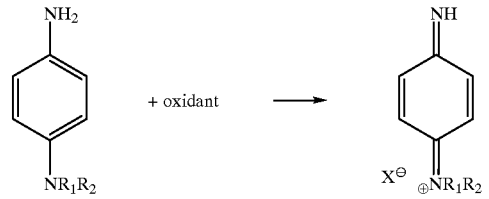

wherein X is an anion derived from the oxidant.

The oxidizing composition generally comprises a liquid vehicle and an oxidizing agent, and functions as a color forming component in the process of the present invention. For the purpose of simplicity, the developing composition will at times hereinafter be referred to as an ink. Any liquid can be employed as the major component of the liquid vehicle, provided that it dissolves or disperses the components of the composition and is of a viscosity appropriate for the selected drop ejector. For example, in thermal ink jet printing systems, a preferred liquid vehicle is water. In other drop ejectors, such as those employing continuous stream processes, piezoelectric ink jet printers, acoustic ink jet printers, and the like, other liquids can also be employed, such as hydrocarbons, glycols, ethers, sulfones such as sulfolane, pyrrolidinones such as 2-pyrrolidinone and N-methyl pyrrolidinone, other dipolar aprotic solvents, and the like, as well as mixtures thereof. The oxidizing composition can also contain other components which might improve its performance as an ink jet ink, such as humectants, penetrants, cosolvents, jetting aids, or the like, set forth in more detail hereinbelow. The oxidizing composition typically contains the oxidizing agent in an amount of from about 0.05 to about 15 percent by weight of the oxidizing composition, preferably from about 0.1 to about 10 percent by weight of the oxidizing composition, and more preferably from about 0.5 to about 5 percent by weight of the oxidizing composition, although the amount can be outside of these ranges. The reaction between the oxidizing agent and the color developer is stoichiometric, and to obtain full color intensity, a full stoichiometric amount or an excess amount of oxidizing agent is employed to oxidize all of the developer. In one embodiment of the present invention, color tone or intensity is controlled by the deposition of variable stoichiometrically insufficient amounts of oxidizing agent.

Examples of suitable oxidizing agents include potassium peroxydisulfate, ammonium peroxydisulfate, hydrogen peroxide, alkylhydroperoxides, of the general formula

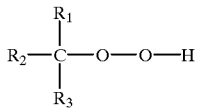

wherein $R_1$, $R_2$, and $R_3$ each, independently of the others, are alkyl groups, preferably with 1 or 2 carbon atoms, although the number of carbon atoms can be outside of this range, or alkylaryl groups, preferably with from 7 to about 9 carbon atoms, although the number of carbon atoms can be outside of this range, such as t-butyl hydroperoxide, cumene hydroperoxide, and the like, dialkylperoxides, of the general formula

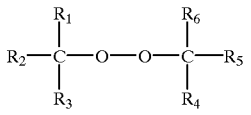

wherein $R_1$, $R_2$, $R_3$, $R_4$, $R_5$, and $R_6$ each, independently of the others, are alkyl groups, preferably with 1 or 2 carbon atoms, although the number of carbon atoms can be outside of this range, or alkylaryl groups, preferably with from 7 to about 9 carbon atoms, although the number of carbon atoms can be outside of this range, such as di-t-butylperoxide, dicumylperoxide, and the like, wherein the class of dialkyl peroxides also includes substituted dialkyl peroxides, such as t-butylperoxybenzoate, of the formula

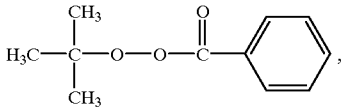

t-butylperoxy isopropyl carbonate, of the formula

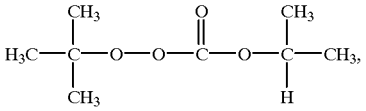

and the like, diacylperoxides, of the general formula

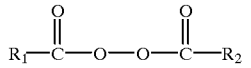

wherein $R_1$ and $R_2$ are each, independently of the others, alkyl groups, preferably with 1 or 2 carbon atoms, aryl groups, preferably with from 6 to about 9 carbon atoms, or alkylaryl groups, preferably with from 7 to about 9 carbon atoms, such as benzoyl peroxide, pivaloyl peroxide, and the like, peroxycarbonates, such as sodium percarbonate and the like, and the like, as well as mixtures thereof. Peroxides such as the above are available from, for example, Aldrich Chemical Co., Milwaukee, Wis., and Alfa Aesar, division of Johnson Matthey Catalog Co., Inc., Ward Hill, Mass.

As indicated, the developer in its oxidized form can react with a dye coupler to form a dye. The coloring composition generally comprises a liquid vehicle and a dye coupler, and functions as a color forming component in the process of the present invention. For the purpose of simplicity, the developing composition will at times hereinafter be referred to as an ink. Any liquid can be employed as the major component of the liquid vehicle, provided that it dissolves or disperses the components of the composition and is of a viscosity appropriate for the selected drop ejector. For example, in thermal ink jet printing systems, a preferred liquid vehicle is water. In other drop ejectors, such as those employing continuous stream processes, piezoelectric ink jet printers, acoustic ink jet printers, and the like, other liquids can also be employed, such as hydrocarbons, glycols, ethers, sulfones such as sulfolane, pyrrolidinones such as 2-pyrrolidinone and N-methyl pyrrolidinone, other dipolar aprotic solvents, and the like, as well as mixtures thereof. The coloring composition can also contain other components which might improve its performance as an ink jet ink, such as humectants, penetrants, cosolvents, jetting aids, or the like, set forth in more detail hereinbelow. The coloring composition typically contains the dye coupler in an amount of from about 0.05 to about 15 percent by weight of the coloring composition, preferably from about 0.1 to about 10 percent by weight of the coloring composition, and more preferably from about 0.5 to about 5 percent by weight of the coloring composition, although the amount can be outside of these ranges. The reaction between the dye coupler and the color developer is stoichiometric, and to obtain full color intensity, a full stoichiometric amount or an excess amount of oxidizing agent is employed to oxidize all of the developer. In one embodiment of the present invention, color tone or intensity is controlled by the deposition of variable stoichiometrically insufficient amounts of dye coupler.

Examples of suitable cyan dye couplers include substituted phenols and α-naphthols, including those of the general formulae

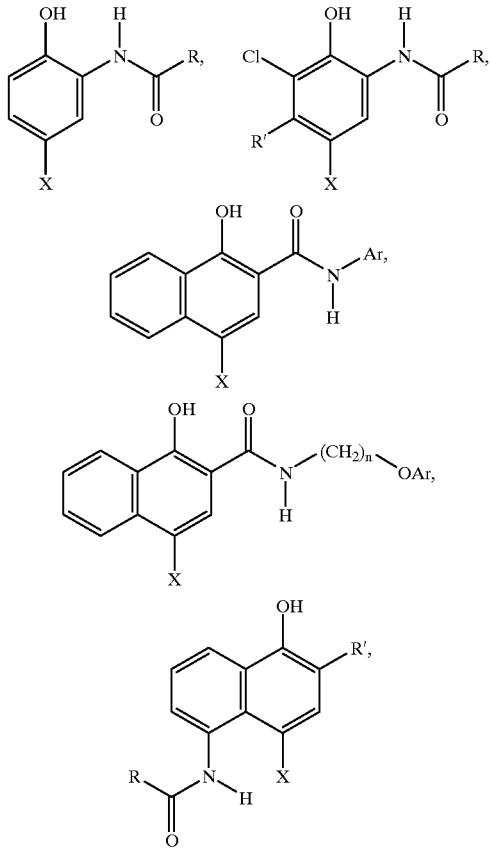

and the like, wherein X is a hydrogen atom, a chlorine atom, an alkoxy group (—OR), an aryloxy group (—OAr), or a thioaryl group (—SAr), n is an integer representing the number of repeat —$CH_2$— units, and preferably is from about 1 to about 3, R and R' each, independently of the others, are organic segments which provide desired solubility characteristics, such as alkyl groups, preferably with from 1 to about 22 carbon atoms, or polar solubilizing groups, such as —COOH or —$SO_3H$, and Ar is an aryl group, including substituted aryl groups, preferably with from 6 to about 14 carbon atoms, or an arylalkyl group, including substituted arylalkyl groups, preferably with from 7 to about 36 carbon atoms. Amphiphilic cyan couplers, such as 1-N-stearoyl-3-N-(1'-hydroxy-2'-naphthoyl)-phenylenediamine-4-sulphonic acid, believed to be of the formula

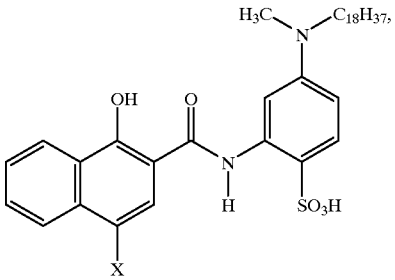

or a salt thereof, such as a sodium salt, are particularly preferred for water based ink formulations such as those suitable for thermal ink jet printing.

Examples of suitable yellow dye couplers include β-ketocarboxamides and pivaloylacetanilides, of the general formulae ballast

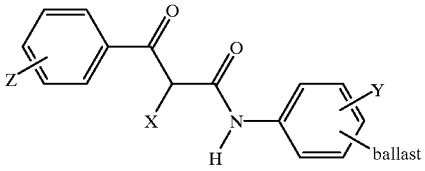

and

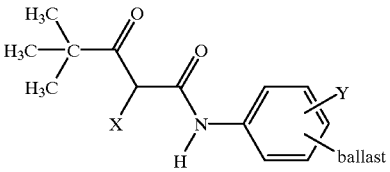

wherein X is a hydrogen atom, a chlorine atom, a —$OSO_2R$ group, a —$SO_2R$ group, a —O—C(═O)R group, or a —SAr group, wherein R is an alkyl group, preferably with from 1 to about 22 carbon atoms, and Ar is an aryl group, preferably with from 6 to about 22 carbon atoms, Y, Z, and "ballast" are each, independently of the others, solubilizing groups, such as an alkyl group (—R), a carboxyl group, a sulfonyl group, or an alkylamide group (—NH—COR), wherein R is an alkyl group, preferably with from 1 to about 22 carbon atoms. Substituents Y and Z can be used to attach ballasting or solubilizing groups and to alter the reactivity of the coupler and the hue of the resulting dyes. Coupling to the oxidized developer generally occurs with displacement of substituent X. Specific examples of suitable yellow dye couplers include 4-(p-toluenesulfonylamino)-ω-benzoylacetanilide, of the formula

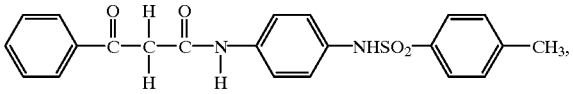

α-benzoyl-o-methoxyacetanilide, of the formula

-continued

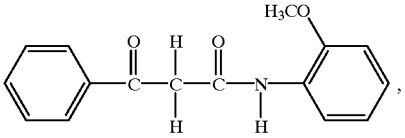

dichloroacetanilide, of the formula

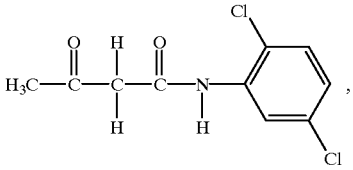

and the like. Amphiphilic yellow couplers, such as para-stearoylamino-benzoyl -acetanilide-3',5'-dicarboxylic acid, believed to be of the formula

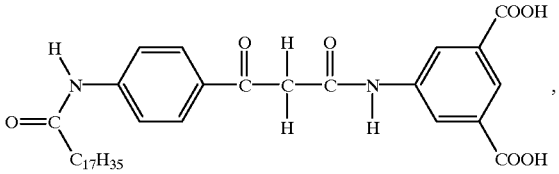

or meta-stearoylamino-benzoyl-acetanilide-para'-carboxylic acid, believed to be of the formula

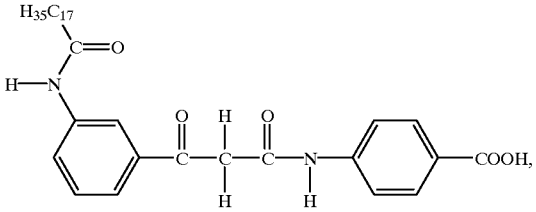

or salts thereof, such as the sodium salts, are particularly preferred for water based ink formulations such as those suitable for thermal ink jet printing.

Examples of suitable magenta dye couplers include those derived from the 1-aryl-2-pyrazolin-5-ones, of the general formulae

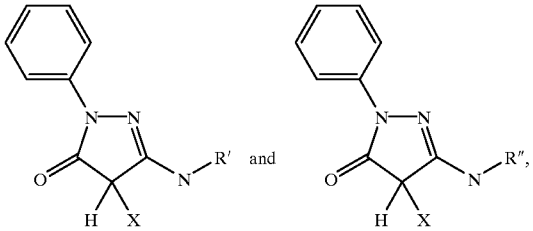

wherein X is

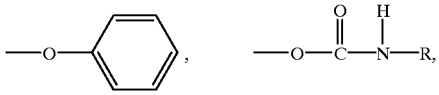

-continued

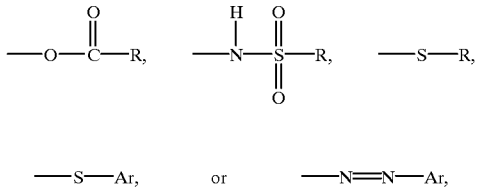

R, R', and R" each, independently of the others, are organic segments which provide desired solubility characteristics, such as alkyl groups, preferably with from 1 to about 22 carbon atoms, or polar solubilizing groups, such as —COOH or —$SO_3H$, and Ar is an aryl group, including substituted aryl groups, preferably with from 6 to about 14 carbon atoms, or an arylalkyl group, including substituted arylalkyl groups, preferably with from 7 to about 36 carbon atoms, the pyrazolo-(3,2, -c)-5-triazoles and related isomers, of the general formula

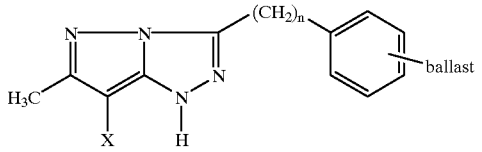

wherein X is a chlorine atom, a thioalkyl group (—SR), a thioaryl group (—SAr), or an aryloxy group (—OAr), n is an integer representing the number of repeat —$CH_2$— units, and preferably is from 0 to about 3, R is an alkyl group, preferably with from 1 to about 22 carbon atoms, Ar is an aryl group, preferably with from 6 to about 22 carbon atoms, and "ballast" represents a solubilizing group, such as an alkyl group (—R), a carboxyl group, a sulfonyl group, or an alkylamide group (—NH—COR), wherein R is an alkyl group, preferably with from 1 to about 22 carbon atoms, and the like. Also suitable are cyanoacetyl derivatives of cyclic systems, such as cyanoacetylcoumarone, of the formula

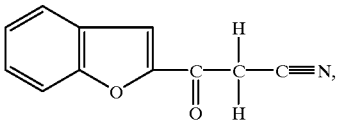

indazolones, of the general formula

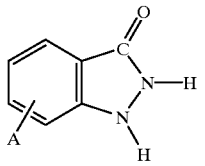

wherein A is a hydrogen atom or a substituent selected to optimize characteristics such as solubility, reactivity, hue, stability, or the like. For example, substituents such as sulfonate (—$SO_3$) or carboxylate (—COOH) can enhance water solubility and suitability for use in aqueous liquids. Specific examples of suitable magenta dye couplers include 2-cyanoacetyl coumarone, of the formula

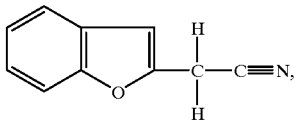

1-(2,4,6-trichlorophenyl)-3-p-nitroanilino-2-pyrazoline-5-one, of the formula

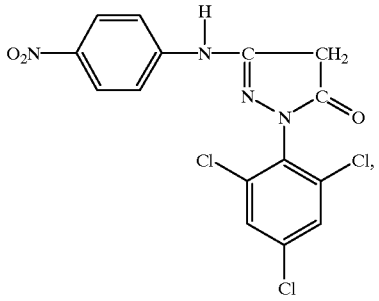

and the like. Amphiphilic magenta couplers, such as 3-heptadecyl-1-(4'-sulfophenyl)-2-pyrazoline-5-one, believed to be of the formula

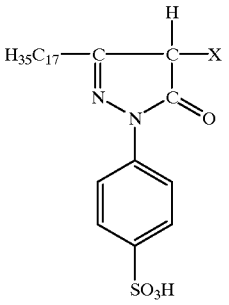

wherein X is a hydrogen atom or a chlorine atom, or 1-(5'-sulpho-3'-stearoyl-aminophenyl)-2-pyrazoline-5-one, believed to be of the formula

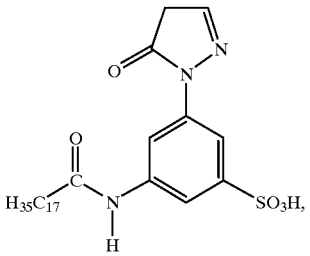

or salts thereof, such as the sodium salts, are particularly preferred for water based ink formulations such as those suitable for use in thermal ink jet printing. Further information regarding dye couplers is disclosed in, for example, *SPSE Handbook of Photographic Science and Engineering*, W. Thomas, Jr., ed., John Wiley & Sons (New York 1973); *Neblette's Handbook of Photography and Reprography,* 7th ed., J. Sturge, ed., Van Nostrand Reinhold Co. (New York 1977); and "The Chemistry of Color Photography," W. C. Guida et al., *Journal of Chemical Education*, Vol. 52, No. 10, p. 622 (October 1975); the disclosures of each of which are totally incorporated herein by reference.

At least one of the developing composition, coloring composition, and oxidizing composition is of a pH sufficiently alkaline to drive the coupling reaction between the oxidized developer and the dye coupler. Accordingly, at least one of these compositions typically also includes a base and/or a buffer. While it is generally simplest to include the base and/or buffer in the oxidizing composition, the developing composition and/or the coloring composition can also have its pH adjusted to an appropriate level to enable the coupling reaction. The composition(s) containing a base and/or a buffer, and having its pH adjusted to enable the coupling reaction, will hereinafter be referred to as the pH adjusted composition. The pH of the pH adjusted composition generally is over about 9, and preferably is from about 10 to about 13, although the value can be outside of this range. Examples of compositions which can be added to the pH adjusted composition to obtain the desired pH include hydroxides such as sodium hydroxide, tetramethylammonium hydroxide, and the like, potassium carbonate, sodium phosphate, or the like, as well as mixtures thereof.

The fixing composition generally comprises a liquid vehicle and a fixative. For the purpose of simplicity, the fixing composition will at times hereinafter be referred to as an ink. Any liquid can be employed as the major component of the liquid vehicle, provided that it dissolves or disperses the components of the composition and is of a viscosity appropriate for the selected drop ejector. For example, in thermal ink jet printing systems, a preferred liquid vehicle is water. In other drop ejectors, such as those employing continuous stream processes, piezoelectric ink jet printers, acoustic ink jet printers, and the like, other liquids can also be employed, such as hydrocarbons, glycols, ethers, sulfones such as sulfolane, pyrrolidinones such as 2-pyrrolidinone and N-methyl pyrrolidinone, other dipolar aprotic solvents, and the like, as well as mixtures thereof. The fixing composition can also contain other components which might improve its performance as an ink jet ink, such as humectants, penetrants, cosolvents, jetting aids, or the like, set forth in more detail hereinbelow. Typically, the fixative is a mixture of a weakly acidic reagent and a reducing agent. The acid is present in the fixing composition in an amount sufficient to neutralize base from the developing composition, coloring composition, and/or oxidizing composition in the initially formed image. The reducing agent is present in the fixing composition in an amount sufficient to quench excess oxidizing components in the initially formed image. The fixing composition typically contains the fixative mixture in an amount of from about 0.1 to about 10 percent by weight of the fixing composition, preferably from about 1 to about 5 percent by weight of the fixing composition, although the amount can be outside of these ranges.

Examples of suitable weakly acidic fixative components include ascorbic acid, phthalic acid, benzoic acid, acetic acid, maleic acid succinic acid, poly(acrylic acid), poly (methacrylic acid), copoly(styrene/maleic acid), copoly (methylvinylether/maleic acid), and the like, as well as mixtures thereof. Examples of suitable reducing fixative components include ascorbic acid, sodium sulfite, sodium bisulfite, glucose and other reducing sugars, and the like, as well as mixtures thereof.

As stated hereinabove, the developing composition, the oxidizing composition, the coloring composition, and the fixing composition (hereinafter collectively referred to as inks or ink compositions of or for the present invention) all generally have compositions which render them suitable for use as ink jet inks in an ink jet printing apparatus. Ink jet inks generally contain an aqueous liquid vehicle. The liquid vehicle can consist solely of water, or it can comprise a mixture of water and a water soluble or water miscible organic component, such as ethylene glycol, propylene glycol, diethylene glycols, glycerine, dipropylene glycols, polyethylene glycols, polypropylene glycols, amides, ethers, urea, substituted ureas, ethers, carboxylic acids and their salts, esters, alcohols, organosulfides, organosulfoxides, sulfones (such as sulfolane), alcohol derivatives, carbitol, butyl carbitol, cellusolve, tripropylene glycol monomethyl ether, ether derivatives, amino alcohols, ketones, N-methylpyrrolidinone, 2-pyrrolidinone, cyclohexylpyrrolidone, hydroxyethers, amides, sulfoxides, lactones, polyelectrolytes, methyl sulfonylethanol, imidazole, betaine, and other water soluble or water miscible materials, as well as mixtures thereof. When mixtures of water and water soluble or miscible organic liquids are selected as the liquid vehicle, the water to organic ratio typically ranges from about 100:0 to about 30:70, and preferably from about 97:3 to about 40:60. The non-water component of the liquid vehicle generally serves as a humectant or cosolvent which has a boiling point higher than that of water (100° C.). In the ink compositions of the present invention, the liquid vehicle is typically present in an amount of from about 80 to about 99.9 percent by weight of the ink, and preferably from about 90 to about 99 percent by weight of the ink, although the amount can be outside these ranges.

Other optional additives to the inks of the present invention include pH controlling agents such as acids or, bases, phosphate salts, carboxylates salts, sulfite salts, amine salts, and the like, present in an amount of from 0 to about 1 percent by weight of the ink and preferably from about 0.01 to about 1 percent by weight of the ink, or the like. One or more surfactants or wetting agents can also be added to the ink. These additives may be of the cationic, anionic, or nonionic types. Suitable surfactants and wetting agents include sodium lauryl sulfate, Tamol® SN, Tamol® LG, those of the Triton® series available from Rohm and Haas Company, those of the Marasperse® series, those of the Igepal® series available from GAF Company, those of the Tergitol® series, and other commercially available surfactants. These surfactants and wetting agents are present in any desired or effective amounts, generally from 0 to about 15 percent by weight of the ink, and preferably from about 0.01 to about 8 percent by weight of the ink, although the amount can be outside of this range.

One example of an additive to the inks of the present invention is a polymeric additive consisting of two polyalkylene oxide chains bound to a central bisphenol-A-type moiety. This additive is of the formula

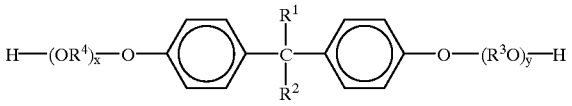

wherein $R^1$ and $R^2$ are independently selected from the group consisting of hydrogen, alkyl groups with from 1 to about 8 carbon atoms, such as methyl, ethyl, propyl, and the like, and alkoxy groups with from 1 to about 8 carbon atoms, such as methoxy, ethoxy, butoxy, and the like, $R^3$ and $R^4$ are independently selected from the group consisting of alkyl groups with from 1 to about 4 carbon atoms, and x and y are each independently a number of from about 100 to about 400, and preferably from about 100 to about 200. Generally, the molecular weight of the polyalkylene oxide polymer is from about 14,000 to about 22,000, and preferably from about 15,000 to about 20,000, although the molecular weight can be outside this range. Materials of this formula are commercially available; for example, Carbowax M20, a polyethylene oxide/bisphenol-A polymer of the above formula with a molecular weight of about 18,000, available from Union Carbide Corporation, Danbury, Conn., is a suitable polymeric additive for the inks of the present invention. In addition, compounds of the above formula can be prepared by the methods disclosed in *Polyethers*, N. G. Gaylord, John Wiley & Sons, New York (1963) and "Laboratory Synthesis of Polyethylene Glycol Derivatives," J. M. Harris, *J. Molecular Science—Rev. Macromol. Chem. Phys., C*25(3), 325–373 (1985), the disclosures of each of which are totally incorporated herein by reference. The polyalkylene oxide additive is generally present in the ink in an amount of at least about 1 part per million by weight of the ink. Typically, the polyalkylene oxide additive is present in amounts of up to 1 percent by weight of the ink, and preferably in amounts of up to 0.5 percent by weight of the ink; larger amounts of the additive may increase the viscosity of the ink beyond the desired level, but larger amounts can be used in applications wherein increased ink viscosity is not a problem. Inks containing these additives are disclosed in U.S. Pat. No. 5,207,825, the disclosure of which is totally incorporated herein by reference.

The ink compositions of the present invention are generally of a viscosity suitable for use in thermal ink jet printing processes. At room temperature (i.e., about 25° C.), typically, the ink viscosity is no more than about 10 centipoise, and preferably is from about 1 to about 5 centipoise, more preferably from about 1 to about 4 centipoise, although the viscosity can be outside this range, particularly for applications such as acoustic ink jet printing.

Ink compositions of the present invention can be of any suitable or desired pH. At least one of the developing composition, coloring composition, and oxidizing composition is sufficiently alkaline to foster the coupling reaction between the color developer and the dye coupler.

Ink compositions suitable for ink jet printing can be prepared by any suitable process. Typically, the inks are prepared by simple mixing of the ingredients. One process entails mixing all of the ink ingredients together and filtering the mixture to obtain an ink. Inks can be prepared by mixing the ingredients, heating if desired, and filtering, followed by adding any desired additional additives to the mixture and mixing at room temperature with moderate shaking until a homogeneous mixture is obtained, typically from about 5 to about 10 minutes. Alternatively, the optional ink additives can be mixed with the other ink ingredients during the ink preparation process, which takes place according to any desired procedure, such as by mixing all the ingredients, heating if desired, and filtering.

In one specific embodiment of the present invention, the ink jet printing apparatus employs a thermal ink jet process wherein the ink in the nozzles is selectively heated in an imagewise pattern, thereby causing droplets of the ink to be ejected in imagewise pattern. In another specific embodiment, the printing apparatus employs an acoustic ink jet process, wherein droplets of the ink are caused to be ejected in imagewise pattern by acoustic beams. Other methods, such as piezoelectric drop on demand ink jet printing, continuous stream ink jet printing, hot melt ink jet printing, or the like, can also be employed.

Any suitable substrate or recording sheet can be employed, including plain papers such as Xerox® 4024 papers, Xerox® Image Series papers, Courtland 4024 DP paper, ruled notebook paper, bond paper, silica coated papers such as Sharp Company silica coated paper, JuJo paper, and the like, transparency materials, fabrics, textile products, plastics, polymeric films, inorganic substrates such as metals and wood, and the like. In a preferred embodiment, the process entails printing onto a porous or ink absorbent substrate, such as plain paper. In embodiments of the present invention wherein special substrates or receiver sheets are used, it can be advantageous to use a paper coated with absorbing layers for specific dye couplers. As disclosed in, for example, Japanese Patent Publication JP 9030107 A, when coloring agents are localized at a specific depth in the receiving sheet, improved color reproduction can be achieved because agents of different color tone do not mingle at the same depth in the absorbing layer.

The specific embodiments of the present invention which enable production of gray-level images have been illustrated hereinabove in the specific context of photographic, including color photographic, materials and development processes. These embodiments of the present invention, namely (1) providing a multiplicity of intensity or "gray" levels within a particular color by controlling the time between the point at which the developing composition, oxidizing composition, and coloring composition all come together and the point at which the fixing composition is deposited; (2) providing a multiplicity of intensity or "gray" levels within a particular color by jetting fixed amounts of one of (a) the developing composition, (b) the coloring composition, or (c) the oxidizing composition onto the substrate in combination with varying amounts the other two compositions, with the limited composition being present in reaction limiting quantities with respect to the other two compositions; and (3) jetting the developing composition, coloring composition(s), and oxidizing composition in an imagewise pattern so that the overlap of droplets of these three compositions is controlled, thereby modulating pixel size to realize variable spot sizes, can also be realized by a multiplicity of other specific chemistries. In some of these embodiments, no fixative is needed; in other embodiments, only two color forming liquid compositions are used instead of three. One embodiment of the present invention is directed to a process which comprises (a) incorporating into an ink jet printing apparatus (1) a color forming composition comprising a liquid vehicle and at least one color forming agent; and (2) a reacting composition comprising a liquid vehicle and at least one material capable of reacting with the color forming agent to cause a desired color to form; (b) causing droplets of the color forming composition to be ejected in an imagewise pattern onto the substrate; and (c) causing droplets of the reacting composition to be ejected in an imagewise pattern onto the substrate; wherein the process results in at least some portions of the substrate bearing images comprising both the color forming composition and the reacting composition, said portions forming a printed image, wherein at time Ti, the color forming composition has formed an image on the substrate, at time $T_2$, the reacting composition is deposited onto a first portion $P_1$ of the image, and at time $T_3$, the reacting composition is deposited onto a second portion $P_2$ of the image, wherein time period $T_1$ to $T_2$ is less than time period $T_1$ to $T_3$, thereby resulting in second portion $P_2$ having a different color intensity from first portion $P_1$. Another embodiment of the present invention is directed to a process which comprises (a) incorporating into an ink jet printing apparatus (1) a color forming composition comprising a liquid vehicle and at least one color forming agent; and (2) a reacting composition comprising a liquid vehicle and at least one material capable of reacting with the color forming agent to cause a desired color to form; (b)

causing droplets of the color forming composition to be ejected in an imagewise pattern onto the substrate; and (c) causing droplets of the reacting composition to be ejected in an imagewise pattern onto the substrate; wherein the process results in at least some portions of the substrate bearing images comprising both the color forming composition and the reacting composition, said portions forming a printed image, wherein one of (i) the color forming composition and (ii) the reacting composition is applied to the substrate in fixed volumes per pixel, and the other of (i) and (ii) is applied to the substrate in varying volume per pixel, thereby varying the intensity of color of the printed image. Yet another embodiment of the present invention is directed to a process which comprises (a) incorporating into an ink jet printing apparatus (1) a color forming composition comprising a liquid vehicle and at least one color forming agent; and (2) a reacting composition comprising a liquid vehicle and at least one material capable of reacting with the color forming agent to cause a desired color to form; (b) causing droplets of the color forming composition to be ejected in an imagewise pattern onto the substrate; and (c) causing droplets of the reacting composition to be ejected in an imagewise pattern onto the substrate; wherein the process results in at least some portions of the substrate bearing images comprising both the color forming composition and the reacting composition, said portions forming a printed image, wherein droplets of the color forming composition and droplets of the reacting composition are applied to the substrate in an imagewise pattern so that droplets of color forming composition and reacting composition overlap in a controlled pattern, thereby forming spots of varying sizes on the substrate, said spots being formed in areas where droplets of the color forming composition and reacting composition overlap.

For example, the present invention includes embodiments wherein more than one color forming agent is combined into a single "ink" or liquid composition for printing. For example, the color developer and the dye coupler can be included in a single "ink" or liquid composition, thereby eliminating the need for a separate developing composition and the need for a separate printhead and cartridge for printing said developing composition. In this embodiment, the use of quinone color developers may be preferred over diamine color developers in view of the higher reactivity (and potential unstability in this embodiment) of the diamines.

In addition, dye developer molecules, commonly used in instant photography, can be used in place of distinct color developer and dye coupler molecules. In this embodiment, the color developer and the dye coupler are covalently bonded in a single molecule. Otherwise, the process is analogous to that described hereinabove with respect to materials commonly used in conventional photography. Further information on the dye developer molecules and processes for the use thereof is disclosed in, for example, "Color Photography, Instant," by Vivian K Walworth and Stanley H. Mervis in *The Encyclopedia of Chemical Technology,* 4fh Edition, Vol. 6, pp.1003–1048, John Wiley & Sons, New York (1993); U.S. Pat. No. 3,443,940; U.S. Pat. No. 2,983,606; U.S. Pat. No. 3,255,001; U.S. Pat. No. 3,201,384; U.S. Pat. No. 3,246,985; U.S. Pat. No. 3,857,855; U.S. Pat. No. 4,264,701; M. Idelson, I. R. Karday, B. H. Mark, D. O. Richter, and V. H. Hooper, *Inorg. Chem.* 6, 450 (1967); E. M. Idelson, Dyes and Pigments 3,191 (1982); and H. G. Rogers, E. M. Idelson, R. F. W. Cieciuch, and S. M. Bloom, *J. Photogr. Sci.* 22, 138 (1974); the disclosures of each of which are totally incorporated herein by reference.

Further, leuco or vat dyes, which are typically colorless unless and until reacted with an oxidizing agent or pH altering agent, can be used in combination with oxidative reagents or pH-altering reagents to visualize them. In this embodiment, no fixative is needed. Otherwise, the process is analogous to that described hereinabove with respect to materials commonly used in conventional photography. Further information on leuco and vat dyes and processes for the use thereof is disclosed in, for example, *IBM Technical Disclosure Bulletin*, Vol. 23, No. 4, p. 1387 (September 1980); U.S. Pat. No. 1,055,115; British Patent 15055/12; and German Patent 257,167, the disclosures of each of which are totally incorporated herein by reference.

Additionally, metal vanadates and polyphenolic compounds, such as gallic acid, tannic acid, dihydroxybenzene carboxylic acids, or dihydroxynaphthalene carboxylic acids, can be used to create durable black images. Otherwise, the process is analogous to that described hereinabove with respect to materials commonly used in conventional photography. Further information on metal vanadates and polyphenolics and processes for the use thereof is disclosed in, for example, Japanese Patent Publication JP 77049366 B, British Patent Publication GB 1398334, and German Patent Publication DE 2505077, the disclosures of each of which are totally incorporated herein by reference.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A developer composition was prepared by admixing 5 parts by weight CD-3 developer (4-(N-ethyl-N-2-methanesulfonylaminoethyl)-2-methyl-phenylenediamine sesquisulfate monohydrate, obtained from Eastman Kodak Co., Rochester, N.Y.), 70 parts by weight of deionized water, 11 parts by weight of tripropylene glycol monomethyl ether (DOWANOL® TPM, obtained from Dow Chemical Co.), 10 parts by weight of dipropylene glycol, 0.05 parts by weight of polyethylene oxide (poly(ethylene glycol)-bisphenol A diglycidyl ether adduct, molecular weight 18,500, obtained from Polysciences), and 3 parts by weight of potassium carbonate.

An oxidizing composition was prepared by admixing 74 parts by weight of deionized water, 11 parts by weight of tripropylene glycol monomethyl ether (DOWANOL® TPM, obtained from Dow Chemical Co.), 10 parts by weight of dipropylene glycol, 0.05 parts by weight of polyethylene oxide (poly(ethylene glycol)-bisphenol A diglycidyl ether adduct, molecular weight 18,500, obtained from Polysciences), 3 parts by weight of potassium carbonate, and 3 parts by weight of potassium peroxodisulfate ($K_2S_2O_8$).

A cyan coloring composition was prepared by admixing 74 parts by weight of deionized water, 11 parts by weight of tripropylene glycol monomethyl ether (DOWANOL® TPM, obtained from Dow Chemical Co.), 10 parts by weight of dipropylene glycol, 0.05 parts by weight of polyethylene oxide (poly(ethylene glycol)-bisphenol A diglycidyl ether adduct, molecular weight 18,500, obtained from Polysciences), and 5 parts by weight of a α-naphthol cyan dye coupler (N-(2-acetamidophenethyl)-1-hydroxy-2-naphthamide, obtained from Fisher Scientific (ACROS ORGANICS), Pittsburgh, Pa.). A magenta coloring composition was made by the same process except that the dye coupler used was 5 parts by weight of a pyrazolinone magenta dye coupler (1-(2,4,6-trichlorophenyl)-3-(p-nitroanilino)-2-pyrazoline-5-one, obtained from Fisher Scientific (ACROS ORGANICS), Pittsburgh, Pa.). A yellow coloring composition was made by the same process except that the dye coupler used was 5 parts by weight of a β-ketocarboxamide yellow dye coupler (2-benzoylacetanilide, obtained from Fisher Scientific (ACROS ORGANICS), Pittsburgh, Pa.).

A fixing composition was prepared by admixing 70 parts by weight of deionized water, 11 parts by weight of tripropylene glycol monomethyl ether (DOWANOL® TPM, obtained from Dow Chemical Co.), 10 parts by weight of dipropylene glycol, 0.05 parts by weight of polyethylene oxide (poly(ethylene glycol)-bisphenol A diglycidyl ether adduct, molecular weight 18,500, obtained from Polysciences), 5 parts by weight of poly(methyl vinyl ether/maleic acid) (GANTREZ MS-955, obtained from GAF Corp., Wayne, N.J.), and 4 parts by weight of sodium sulfite ($Na_2SO_3$).

A microliter syringe was then used to deposit controlled volumes of the developer composition onto XEROX® Color Xpressions® paper. Stoichiometric quantities of the oxidizing composition and the cyan coloring composition were then deposited directly onto the spots containing the developer composition to yield intensely colored cyan spots.

The process was repeated with varying volumes of the oxidizing composition to yield cyan colored spots of varying intensity.

The process was repeated so that the droplets of developing composition, oxidizing composition, and coloring composition did not overlap completely. Intensely colored cyan spots of fractional size (compared to those obtained with 100 percent droplet overlap) were obtained only in those areas wherein the droplets of developing composition, oxidizing composition, and coloring composition overlapped.

The reactions were quenched by deposition of a stoichiometric excess of the fixing composition onto the developed spots.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A process which comprises (a) incorporating into an ink jet printing apparatus (1) a color forming composition comprising a liquid vehicle and at least one color forming agent; and (2) a reacting composition comprising a liquid vehicle and at least one material capable of reacting with the color forming agent to cause a desired color to form; (b) causing droplets of the color forming composition to be ejected in an imagewise pattern onto the substrate; and (c) causing droplets of the reacting composition to be ejected in an imagewise pattern onto the substrate; wherein the process results in at least some portions of the substrate bearing images comprising both the color forming composition and the reacting composition, said portions forming a printed image, wherein droplets of the color forming composition and droplets of the reacting composition are applied to the substrate in an imagewise pattern so that droplets of color forming composition and reacting composition overlap in a controlled pattern, wherein an amount of overlap of the color forming composition and the reacting composition is varied, thereby forming spots of varying sizes on the substrate, said spots being formed in areas where droplets of the color forming composition and reacting composition overlap.

2. A process according to claim 1 wherein the color forming composition comprises a color developer molecule and the reacting composition comprises an oxidizing agent.

3. A process according to claim 1 wherein the color forming composition comprises a leuco dye or vat dye and the reacting composition comprises an oxidizing agent or pH altering agent.

4. A process according to claim 1 wherein the color forming composition comprises a metal vanadate and the reacting composition comprises a polyphenolic compound.

5. A process according to claim 1 wherein the color forming composition comprises a mixture of two of (i) a developing composition, (ii) a coloring composition, and (iii) an oxidizing composition, and the reacting composition comprises the remaining composition of (i), (ii), and (iii).

6. A process according to claim 1 wherein the printing apparatus employs a thermal ink jet process wherein the ink in the nozzles is selectively heated in an imagewise pattern, thereby causing droplets of The ink to be ejected in imagewise pattern.

7. A process according to claim 1 wherein the printing apparatus employs an acoustic ink jet process, wherein droplets of the ink are caused to be ejected in imagewise pattern by acoustic beams.

8. A process according to claim 1 wherein the printing apparatus employs a piezoelectric ink jet printing process.

9. A process according to claim 1 wherein the printing apparatus employs a continuous stream ink jet printing process.

10. A process according to claim 1 wherein the printing apparatus employs a hot melt ink jet printing process.

11. A process according to claim 1 wherein three different color forming compositions are incorporated into the printing apparatus, one containing a cyan dye color forming agent, one containing a magenta dye color forming agent, and one containing a yellow dye color forming agent.

* * * * *